US007731194B2

(12) United States Patent
Ishihara et al.

(10) Patent No.: US 7,731,194 B2
(45) Date of Patent: Jun. 8, 2010

(54) GAME PIECE AND METHOD OF PLAYING GAME USING SAME

(76) Inventors: Tsunekazu Ishihara, 2-1-16-802 Kudan-minami, Chiyoda-ku, Tokyo (JP) 102-0074; Kouichi Oyama, 1-6-7 Ida, Nakahara-ku, Kawasaki-shi, Kanagawa (JP) 211-0035; Masayuki Miura, #105, 1-8-11 Sengawa, Chofu, Tokyo (JP) 182-0002

( * ) Notice: Subject to any disclaimer, the term of this patent is extended or adjusted under 35 U.S.C. 154(b) by 385 days.

(21) Appl. No.: 11/482,462

(22) Filed: Jul. 6, 2006

(65) Prior Publication Data

US 2007/0018397 A1 Jan. 25, 2007

Related U.S. Application Data

(60) Provisional application No. 60/696,966, filed on Jul. 6, 2005.

(51) Int. Cl.
*A63F 3/00* (2006.01)

(52) U.S. Cl. ..... 273/288; 273/289

(58) Field of Classification Search ..... 273/288, 273/289

See application file for complete search history.

(56) References Cited

U.S. PATENT DOCUMENTS 1,529,132 A 3/1925 Jimison
2,253,823 A 8/1941 Suteras
2,572,412 A 10/1951 Wharton, Jr.
2,733,068 A 1/1956 Elander
2,767,517 A * 10/1956 Hooper ..... 446/139
3,053,537 A 9/1962 Moss
3,222,068 A * 12/1965 Cowels, Jr. ..... 273/247
3,588,114 A 6/1971 Vogel
4,531,739 A * 7/1985 Dunn et al. ..... 273/127 C
4,575,094 A * 3/1986 Ferris et al. ..... 273/249
4,579,347 A 4/1986 Reman
4,852,887 A 8/1989 Li
5,429,370 A 7/1995 Binder (Continued)

FOREIGN PATENT DOCUMENTS

WO WO 2004/037361 5/2004
WO WO 2004037361 5/2004

OTHER PUBLICATIONS

Pokemon(R) Gotta catch 'em all!TM, Advanced Rulebook, Version 5, Trading Card Game, Presented by The Pokemon Company, Manufactured and distributed by Wizards of the Coast, Inc.,(c) 1995-2000 Nintendo, Creatures, GAMEFREAK.

(Continued)

*Primary Examiner*—Vishu K. Mendiratta
(74) *Attorney, Agent, or Firm*—Cowan, Liebowitz & Latman, PC

(57) ABSTRACT

An article of manufacture for use by a player in a game or as a collectible figure, comprising a first portion comprising a representational figure and a second portion affixed to the first portion and comprising a coupling member arranged to be coupled with a preexisting support structure so that a user of the article of manufacture is enabled to couple it with the support structure and uncouple it therefrom.

50 Claims, 8 Drawing Sheets

U.S. PATENT DOCUMENTS

| | | | |
|---|---|---|---|
| 5,662,332 | A | 9/1997 | Garfield |
| 6,213,466 | B1 | 4/2001 | Rosen |
| RE37,957 | E | 1/2003 | Garfield |
| 6,601,851 | B1 | 8/2003 | Sakamoto |
| 2002/0180150 | A1 | 12/2002 | Weisman |
| 2003/0071414 | A1 | 4/2003 | Weisman |
| 2004/0051244 | A1 | 3/2004 | Weisman |
| 2005/0017450 | A1 | 1/2005 | Weisman |
| 2005/0040598 | A1 | 2/2005 | Wilk |
| 2005/0077676 | A1 | 4/2005 | Long |

OTHER PUBLICATIONS

Pokemon (R) Gotta catch 'em allTM, Advanced Rulebook, Version 5, Trading Card Game, Presented by The Pokemon Company, Manufactured and distributed by Wizards of the Coast, INc., (c) 1995-2000 Nintendo.

* cited by examiner

GAME PIECE AND METHOD OF PLAYING GAME USING SAME

CROSS-REFERENCE TO RELATED APPLICATIONS

This application is a non-provisional application based on provisional application Ser. No. 60/696,966, filed Jul. 6, 2005, the entire disclosure of which is hereby incorporated by reference.

BACKGROUND OF THE INVENTION

The present invention concerns game pieces, games that employ game pieces and methods of playing a game using one or more game pieces.

Game manufacturers produce a variety of game pieces and battle games for two or more players, in which the game pieces can be employed. Trading card games, in which trading cards collected by players are used for battling other players' trading cards, are well known. Conventional trading card games typically include a plurality of character battle cards which can be used alone or in combination with energy cards to battle other players' character battle cards. An example of a trading card game is disclosed in U.S. Pat. No. 6,601,851, which discloses a card game toy that includes a master card representing the player and a plurality of monster battle cards, each of which includes a printed representation of the monster and printed characteristics of the monster. In playing the game of the '851 patent, each player's battle cards and master card are placed on a battle field and each player is capable of attacking an opponent's battle card or master card, defending one's own battle or master card, moving one of the battle cards within the battle field or evicting a battle card from the battle field. When one player uses one of its cards to attack one or more of another player's cards, the printed characteristics are used to determine the outcome or result of the attack.

Some conventional games have added a degree of realism to the game by using three-dimensional figures representing characters in the game instead of trading cards. An example of such games is disclosed in U.S. published applications numbers US 2002/0180150 and US 2003/0071414. In particular, the 2002/0180150 and 2003/0071414 publications disclose using miniature figures as game pieces in a game, in which the game pieces of opposing players are used to battle one another. In order to eliminate frequent reference to a manual to keep track of changes in the characteristics of each game piece as the game progresses, each of the game pieces in the 2002/0180150 and 2003/0071414 includes a base and variable printed characteristics of the game piece inserted in the base, such that the base can be adjusted to display current characteristics of the game piece. The characteristics displayed on the base of the game piece are used in determining the outcome of the attack or defense when one player uses its game piece to battle another player's game piece.

In the above-described conventional games, the determination of the outcome of the battle between two game pieces is often complicated and may become tedious for the players, since the game pieces typically include multiple characteristics. Accordingly, a game piece for use in a battle game and a battle game which simplifies the determination of the battle outcome is desired. Moreover, in order to enhance the enjoyment of the battle game, a game that includes additional new characters, options and strategies is also desired.

BRIEF DESCRIPTION OF THE DRAWINGS

The above and other features and aspects of the present invention will become more apparent upon reading the following detailed description in conjunction with the accompanying drawings, in which.

DISCLOSURE

Figure 1:
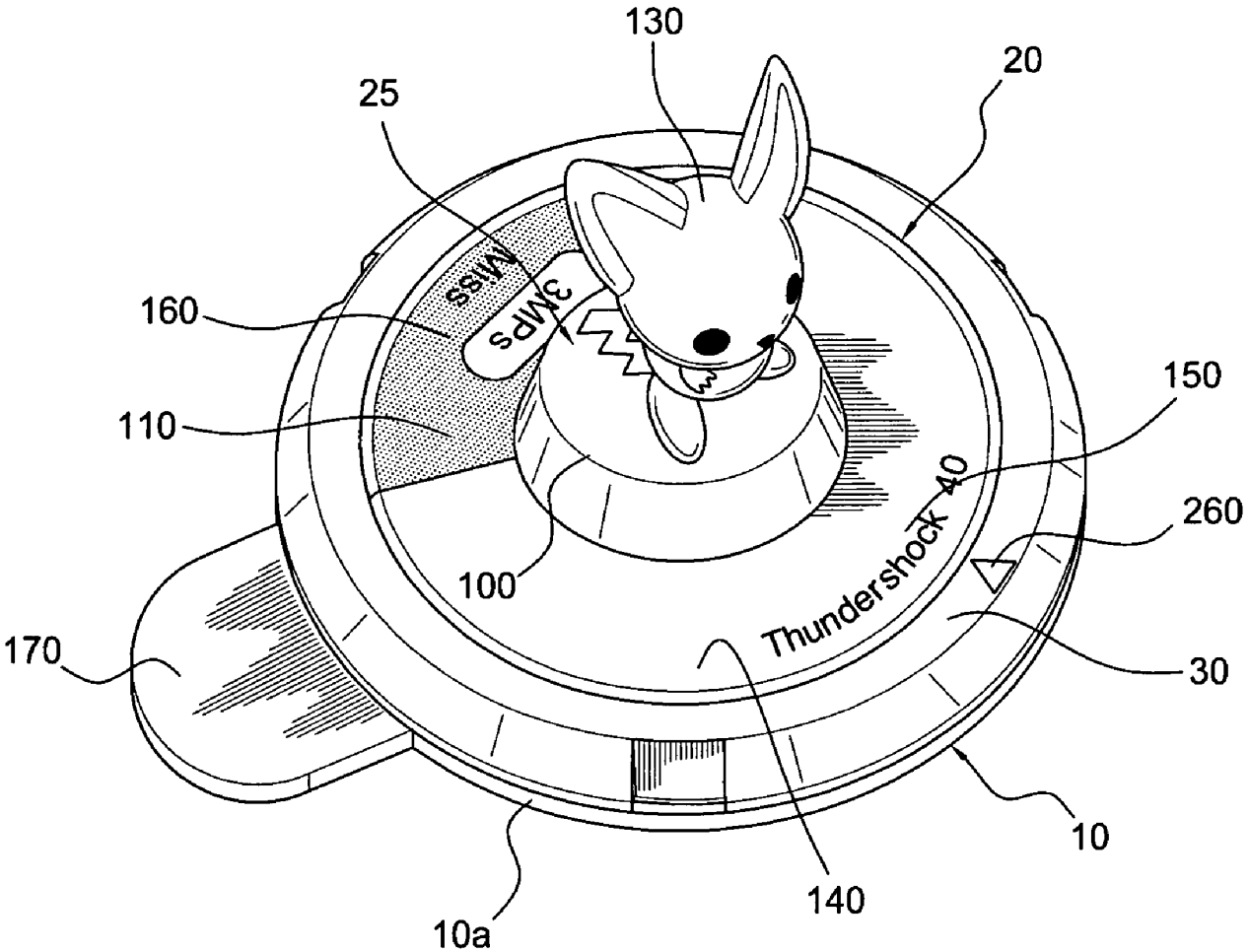
FIG. 1 shows an assembled game piece.

An article of manufacture for use by a player in a game or as a collectible figure, comprises a first portion comprising a representational figure, and a second portion affixed to the first portion and comprising a coupling member arranged to be coupled with a preexisting support structure so that a user of the article of manufacture is enabled to couple it with the support structure and uncouple it therefrom. In certain embodiments, the coupling member is arranged to couple with the preexisting support structure so that the coupling member is freely rotatable thereon.

A game piece comprises the article of manufacture and the preexisting support structure, such that the article of manufacture is supported by the preexisting support structure and is freely rotatable thereon. In certain embodiments, one of the article of manufacture and the preexisting support structure of the game piece comprises an index indicator and the other one of the article of manufacture and the preexisting support structure comprises game related indicia so that when the article of manufacture is rotated with respect to the preexisting support structure, the index indicator is registered with the game related indicia.

A game piece comprises the article of manufacture and the preexisting support structure such that the article of manufacture is supported by the preexisting support structure and the preexisting support structure comprises a base and a retaining member, the retaining member being releasably engaged with the base, and the coupling member of the article of manufacture is captured between the base and the retaining member, the retaining member and the base being arranged such that they may be released from engagement by rotation of the retaining member with respect to the base.

A game piece comprises the article of manufacture and the preexisting support structure, with the article of manufacture being supported by the preexisting support structure and the game piece further comprises indicia on one of the article of manufacture and the preexisting support structure representing a plurality of attack parameters usable in a preexisting game, the indicia being movable with respect to the other of the article of manufacture and the preexisting support structure in response to a force applied by a user, wherein selection of an attack parameter from the plurality of attack parameters is determined by a position at which the indicia rests after being moved by the user.

An article of manufacture for use by a player in a game or as a collectible figure, comprises a support member adapted to support a representational figure, a base member and a retaining member, wherein the base member and the retaining member are adapted to capture the support member therebetween, and the retaining member is adapted to releasably engage with the base member by rotating one of the base member and the retaining member with respect to the other of the base member and the retaining member.

An article of manufacture for use by a player in a game comprises a collectable figure comprising a representational figure on a support member, a base, and a retaining member, the retaining member being rotatable relative to the base with the support member therebetween to releasably engage the retaining member with the base and capture the support member therebetween.

The game pieces of the present invention are useful in games of many kinds, including games involving battles or other contests between or among the game pieces, sports games (for example, baseball or football), adventure games, role playing games, racing games, knowledge games, party games, social simulation games, strategy games, battle simulation games and memory games.

Certain game piece embodiments disclosed herein include figures representing fictional animals. However, in other embodiments the game pieces include one or more figures representing real animals, or real or fictional persons. In still other embodiments, in place of or in addition to such a figure, the game piece includes an object such as a marker, a scoring or record keeping device, a structure, sports equipment, a weapon, a tool, a vehicle, a device or the like, or a representation of such an object.

Figure 2:
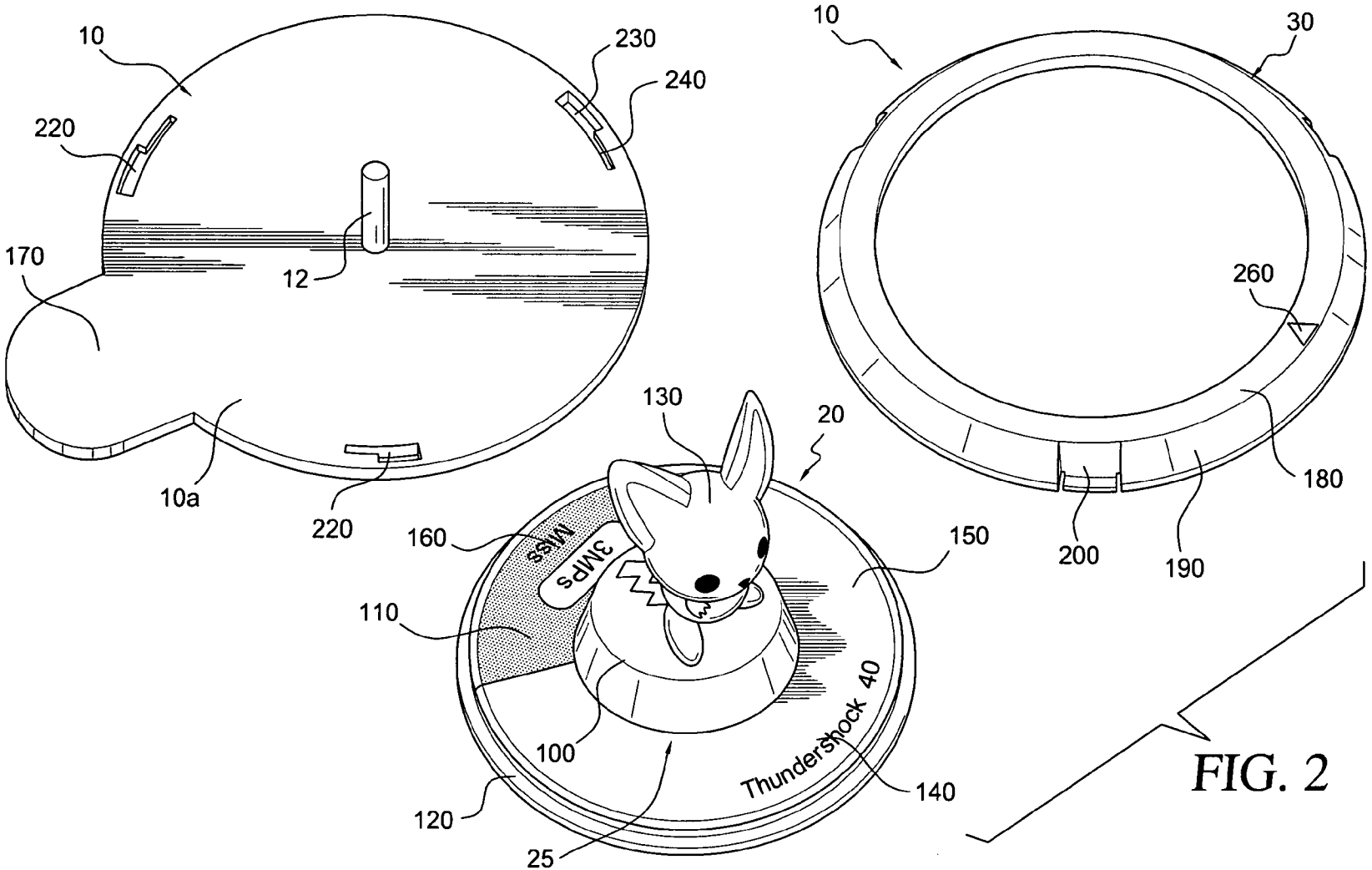
FIG. 2 shows the game piece of FIG. 1 disassembled into its component parts.

FIG. 1 illustrates an assembled game piece 20 and FIG. 2 shows the game piece 20 disassembled into its component parts. As shown in FIGS. 1 and 2, the game piece 20 comprises a representational figure 130 on a support member 25 and a base 10, with the support member 25 being freely rotatable relative to the base 10. In certain embodiments, one of the support member 25 and the base 10 includes an index indicator 260, and the other one of the support member 25 and the base 10 includes game related indicia 140, so that when the support member 25 is rotated with respect to the base 10, the index indicator 260 is registered with the game related indicia 140.

As illustrated in FIGS. 1 and 2, the representational figure 130 may comprise a three-dimensional character which represents the identity of the game piece 20 and is mounted on an upper surface of the support member 25. In other embodiments, the representational figure may comprise a two-dimensional piece such as, for example, a card showing the identity of a character or an item used in a game, or any other representational element which identifies or represents a character or an item that can be used in a game. In certain embodiments, the representational figure 130 and the support member 25 are formed as separate pieces and then affixed to one another, while in others the representational figure 130 and the support member 25 are formed as a single piece. In certain embodiments, the support member 25 and the base 10 are formed from a molded plastic material, such as molded ABS, having a low friction surface which enables the support member 25 to rotate freely in relation to the base 10.

In certain embodiments, the base 10 includes a base member 10*a* and a retaining member 30 releasably engaged with the base member 10*a*, such that the support member 25 is captured between the base member 10*a* and the retaining member 30. In certain embodiments, the retaining member 30 can be rotated relative to the base member 10*a* so as to releasably engage therewith and so as to capture the support member 25 between the base member 10*a* and the retaining member 30. In one of the illustrative embodiments, the retaining member 30 includes a plurality of retainer fingers 200 formed integrally with the retaining member 30 and sized and positioned to engage with a respective slot or recess 220 formed in the base member 10*a*. In particular, and with reference to FIG. 5, each slot or indentation 220 includes a first portion 230 sized to permit a respective one of the retainer fingers 200 to pass therethrough and a second portion 240 sized to capture the retainer finger 200 to as to prevent separation of the retaining member 30 from the base member 10*a*. In the embodiment shown, the width of the first portion 230 is greater than the width of the second portion 240. Illustrative configurations of the retainer fingers 200 and the slots or recesses 220 formed in the retaining member 30 and the base member 10*a*, respectively, are shown in more detail in FIGS. 4-8 and are described in more detail herein below.

In certain embodiments, the support member 25 includes a central member 100 having a flat upper surface and a medial ring 110 extending outwardly from the central member 100. In the illustrative configuration shown in FIGS. 1 and 2, the central member 100 is shaped as a truncated cone and the representational figure 130 is mounted on the flat upper surface of the central member 100. As also illustratively shown in FIGS. 2 and 3, the support member 25 may include an outer ring-shaped lip 120 extending downwardly from the central member 100 and thence outwardly a short distance. The lip 120 enables the support member 25 to be retained by the retaining member 30 of the base 10. In particular, in the illustrative configuration shown, the retaining member 30 comprises a ring-shaped member having an inner diameter which is smaller than an outer diameter of the lip 120 of the support member 25. In an assembled state, the retaining member 30 partially covers the lip 120 of the support member 25 so as to capture and retain the support member 25 between the retaining member 30 and the base member 10*a*.

Figure 3:
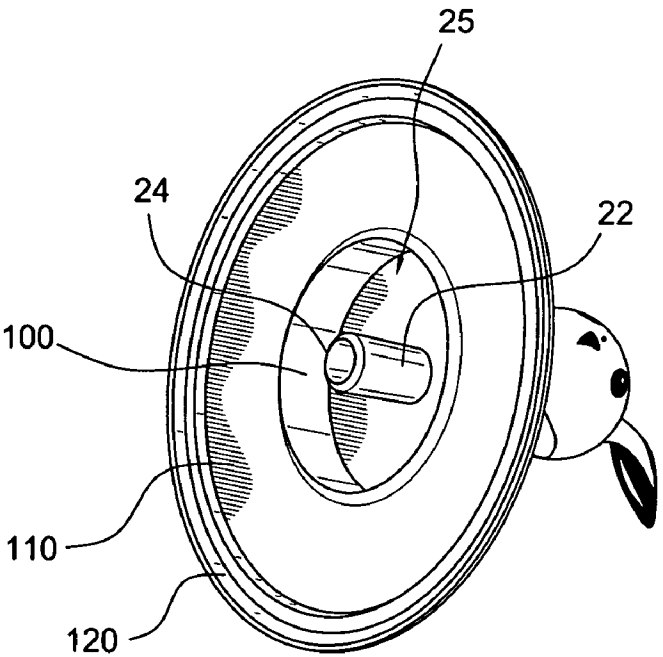
FIG. 3 shows a perspective view of a bottom surface of the support member of the game piece of FIGS. 1 and 2.

FIG. 3 illustrates a perspective view of a bottom surface of the support member 25 of the game piece 20 shown in FIGS. 1 and 2. As shown in FIG. 3, in certain embodiments, the support member 25 includes a bushing 22 having a substantially cylindrical inner surface. The bushing 22 can be formed on the lower surface of the central member 100 of the support member. Referring now to FIG. 2, the base member 10*a* includes a post 12 formed on its upper surface. The post 12 has a substantially cylindrical shape, and the inner surface of the bushing 22 is dimensioned to fit closely over the post 12 in order to mount the support member 25 on the base member 10*a*.

When the support member 25 is mounted on the base member 10*a*, as shown in FIG. 1, the weight of the support member 25 and the representational figure 130 thereon is borne by a lowermost edge 24 of the bushing 22 against an upper surface of the base member 10*a*. The low friction surface of the support member 25 and the base member 10 allows the support member 25 to rotate freely on the lowermost edge 24 of the bushing 22 supported by the upper surface of the base member 10*a*.

In certain embodiments, the base member 10*a* is also provided with a projection 170, as shown in FIGS. 1 and 2. This projection 170 can be grasped by a user to enable the user to maintain a firm grip on the game piece 20 when the support member 25 is rotated relative to the base 10.

In certain embodiments, the game related indicia 140 provided on one of the support member 25 and the base 10 represents a plurality of attack parameters 150, 160 and is movable with respect to the other of the support member 25 and the base 10 in response to a force applied by a user. Selection of an attack parameter 150, 160 from the plurality of attack parameters of the game related indicia 140 is determined by a position at which the indicia 140 rests after being moved by the user.

In certain embodiments, the game related indicia 140 is provided on a label or a sticker and includes a plurality of sections 150, 160, each section representing one or more attack parameters. The attack parameter represented by the indicia can be one or more of an action, a condition or a capability of the piece 20. In the embodiment shown in FIGS. 1 and 2, the sections 150, 160 of the game related indicia 140 comprise arcuate segments printed on a sticker which is affixed to the support member 25. In particular, as shown in FIGS. 1 and 2, the sticker is affixed to an upper surface of the medial ring 110 of the support member 25. As also illustratively shown, the index indicator 260 can be in the form of an arrow provided on an upper surface of the base 10 and, in particular, on an upper surface of the retaining member 30. Using this configuration of the game piece 20, if a user applies a force to the support member 25 or the representational figure 130 mounted on the support member 25 so as to rotate the support member 25 relative to the base 10, the game related indicia 140 moves with the support member 25 relative to the index indicator 260 and the base 10. When the support member 25 and the game related indicia 140 come to rest relative to the base 10 and the index indicator arrow 260, that section 150, 160 of the game indicia 140 which is registered with the index indicator 260 can be selected as the attack parameter. As described herein below, the selection of the attack parameter can be used by the user when playing a game using one or more of the game pieces 20.

Although the game piece 20 shown in FIGS. 1 and 2 includes two sections 150, 160 corresponding to attack parameters "Thundershock" and "Miss," it is understood that the game indicia may include more than two sections and that the same attack parameter may be represented by more than one section of the game indicia. Thus, for example, game indicia may include two sections representing actions such as "Mow Down," "Earthquake," a section representing a capability such as "Dodge," and two sections representing an action such as "Miss" separated by one of the other sections.

Some attack parameters may also include a predetermined value assigned or corresponding thereto. For example, the predetermined value may represent a damage value or a defense value corresponding to an attack parameter representing an action. Moreover, the game indicia may include other parameters such as a moving value for the piece 20 representing an allowable number of spaces or a maximum distance that the piece 20 is can move in one turn.

Figure 4:
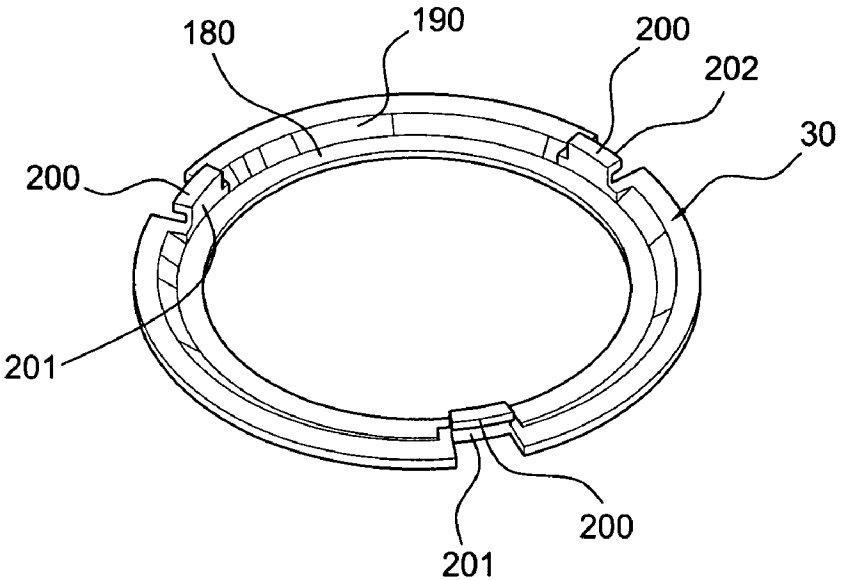
FIG. 4 shows a bottom perspective view of one of the embodiments of a retaining member component of the game piece of FIGS. 1 and 2.

FIG. 4 illustrates a bottom perspective view of one of the embodiments of the retaining member 30 of the base 10. The retaining member 30 may be formed from similar molded materials as the base member 10*a*, including, but not limited to, molded ABS material. In this embodiment, the retaining member 30 has a ring shape and includes an inner ring portion 180 having an inner diameter which, as described above, is smaller than the outer diameter of the outer lip 120 of the support member 25. In certain configurations, the retaining member 30 also includes an outer skirt portion 190 extending outwardly and downwardly from an outer edge of the inner ring 180. A lower surface of the outer skirt portion 190 of the retaining member 30 abuts the upper surface of the base member 10*a* when the retaining member 30 is engaged with the base member 10*a*.

In the illustrative embodiment shown in FIG. 4, the periphery of the outer skirt 190 is interrupted by a plurality of retaining fingers 200 spaced about the circumference of the retaining member 30. As can be appreciated, the number of the retaining fingers 200 is not limited to that shown in FIG. 4 and may vary depending on the size and the desired construction of the game piece 20. In addition, the retaining fingers 200 may be equally spaced about the retaining member's circumference or may be provided at varying intervals. In the illustrative configuration shown in FIG. 4, each of the retaining fingers 200 is formed integrally with the retaining member 30 to have a wall 201 projecting downwardly from the inner ring 180 to an outwardly projecting portion 202.

Figure 5:
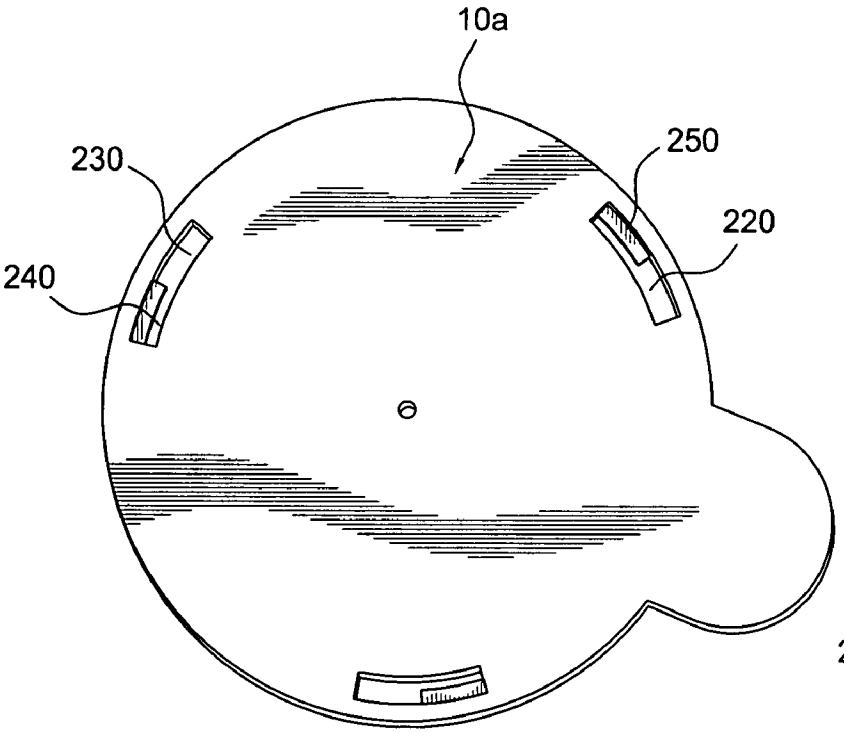
FIG. 5 shows the retaining member of FIG. 4 used together with a base member of the game piece of FIGS. 1 and 2.

As discussed above, each of the retaining fingers 200 is formed and positioned so as to engage with a respective slot or recess 220 formed in the base member 10*a*. FIG. 5 illustrates a perspective view of base member 10*a* which is adapted to engage with the retaining member 30 of FIG. 4. In particular, FIG. 5 shows a detailed view of a bottom surface of the base member 10*a*. As illustratively shown, the base member 10*a* includes a plurality of slots 220, each of which includes the first portion 230 and the second portion 240. The first portion 230 has a greater width than the second portion 240 and is sized so as to allow one of the retaining fingers 200 to pass therethrough. The second portion 240 is sized so that the width of the outwardly projecting portion 202 of the retaining finger 200 is greater than the second portion 240.

In certain embodiments, the second portion 240 is formed by an inwardly projecting flange 250, an upper surface of which is co-extensive with the upper surface of the base member 10*a*. The thickness or height of the flange 250 is smaller than the height or thickness of the base member 10*a*, thus forming a notch or an indentation along the length of the flange 250.

When the retaining member 30 illustrated in FIG. 4 is used together with the base member 10*a* shown in FIG. 5, each of the retaining fingers 200 is first inserted into the first portion 230 of the respective slot or recess 220 in the base member 10*a*. The retaining member 30 is then rotated relative to the base member 10*a* so that each of the retaining fingers 200 slides into the second portion 240 of the respective slot or recess 220 in the base member 10*a*. In this way, the outwardly projecting portion 202 of each retaining finger 220 is captured by the respective flange 250 forming the second slot portion 240 such that an upper surface of each outwardly projecting portion 202 abuts the respective flange 250. The narrower width of the second portion 240 prevents the retaining finger 220 from disengaging from the base member 10*a*. Moreover, due to the smaller thickness of the flange 250 relative to the thickness of the base member 10*a*, the outer portion 202 of the retaining finger can be housed in the notch or indentation formed along the length of the flange 250. This illustrative configuration of the flange 250 prevents the outer portion 202 of the retaining finger 200 captured by the flange 250 from protruding outwardly from the bottom surface of the base member 10*a*, so that the bottom surface of the base member 10*a* is leveled when the game piece 20 is in the assembled state.

Figure 6:
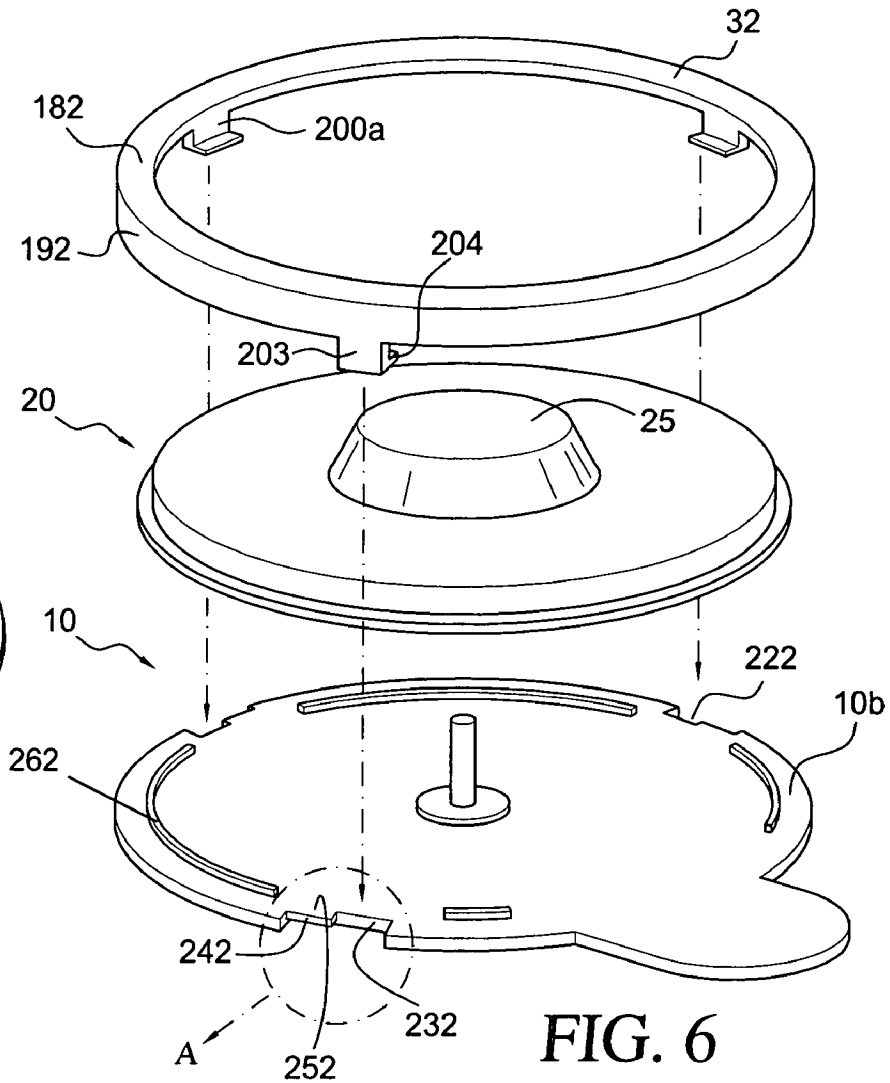
FIG. 6 schematically illustrates another embodiment of the retaining member and the base member.
Figure 7:
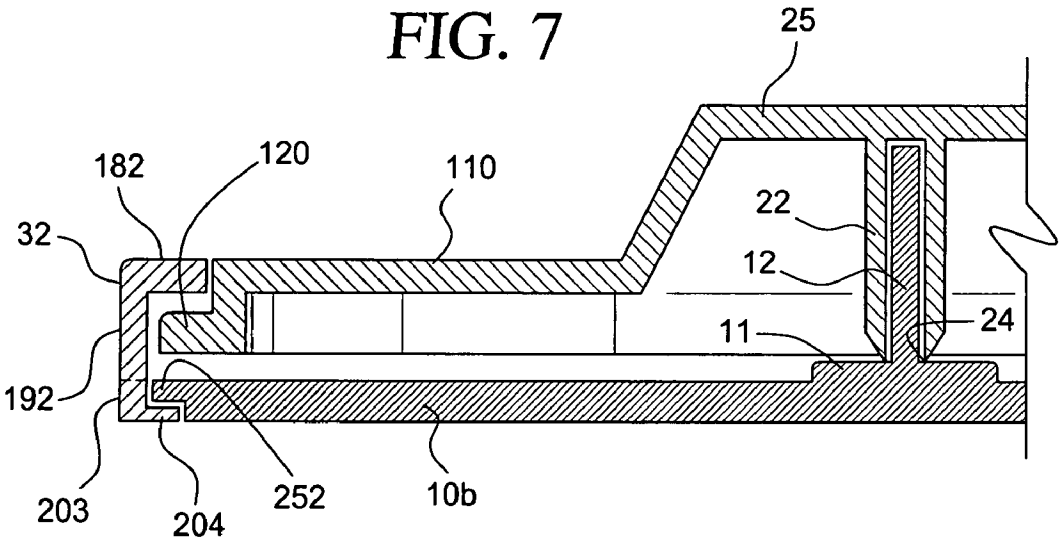
FIG. 7 schematically illustrates a cross-sectional view of the retaining member and the base member of FIG. 6.

FIGS. 6 and 7 schematically illustrate another embodiment of the retaining member 32 and the base member 10*b*. In certain embodiments, the retaining member 32 has a ring shape and includes an inner ring portion 182 and an outer wall portion 192 extending downwardly from an outer edge of the inner ring portion 182. With reference to FIG. 7, the inner diameter of the inner ring portion 182 is smaller than the outer diameter of the outer lip 120 of the support member 25, so that in an assembled state, the outer lip 120 is partially covered by the ring portion 182 of the retaining member 32. The outer diameter of the inner ring portion 182 is slightly larger than the outer diameter of the outer lip 120 so as to allow the support member 25 to freely rotate relative to the retaining member 32. In certain embodiments, the base member 10*b* is provided with a plurality of slightly raised, arcuate segments 262 on its upper surface spaced a small distance from the lateral edge of base member 10*b*. The distance of the arcuate segments from the lateral edge of the base member 10*b* is selected so that an upper edge of each of arcuate segments 262 opposes a lower surface of the outer lip 120 of the support member 25. Accordingly, lateral forces exerted by a player on the retaining member 32 will be absorbed by the arcuate segments 262 without resulting in a permanent deformation of the support member 25 that causes the surface of outer lip 120 to come in contact with the surface of the base member 10*b* when the support member 25 spins on the base member 10*b*. The arcuate segments 262 also serve as guides for mounting the retaining member 32 on the base member 10*b*.

As illustratively shown in FIG. 6, in certain embodiments, the retaining member 32 includes a plurality of retaining fingers 200*a* formed at the lower periphery of the outer wall portion 192. In particular, the lower periphery of the outer wall portion 192 is interrupted by the retaining fingers 200*a* spaced about the circumference of the retaining member, wherein each of the retaining fingers 200*a* includes a wall 203 projecting downwardly from the lower periphery of the outer wall portion 192 and an inwardly projecting portion 204. As discussed above with respect to FIG. 4, the number of, and the intervals between, the retaining fingers 200*a* may vary.

As also illustratively shown in FIG. 6, in certain embodiments, the base member 10*b* adapted to engage with the retaining member 32 also shown in FIG. 6 includes a plurality of recesses 222 formed along the outer periphery of the base member 10*b*. Each of the recesses 222 is formed and positioned so as to engage with the respective retaining finger 200*a* formed on the retaining member 32. As illustrated in FIG. 6, each recess 222 extends inwardly from the outer periphery of the base member 10*b* and includes a first portion 232 and a second portion 242. The distance by which the first portion 232 extends inwardly from the outer periphery of the base member 10*a* is greater than the distance of the inward extension of the second portion 242, so that the width of the first portion 232 is greater than the width of the second portion 242. Particularly, the width of the first portion 232 is such that the inwardly projecting portion 204 of the respective retaining finger 200*a* can be accommodated thereby and is allowed to pass therethrough. The second portion 242 is sized so that it captures and engages with the inwardly projecting portion 204 of the retaining finger 200*a*.

In certain embodiments, the second portion 242 of each recess 222 is formed by an outwardly projecting flange 252 having its upper surface co-extensive with the upper surface of the base member 10*b*. The thickness or height of the flange 252 is smaller than the thickness or height of the base member 10*b*, forming a notch or an indentation along the length of a lower surface of the flange 252.

When the retaining member 32 and the base member 10*b* illustrated in FIG. 6 are used together, the base member 10*b* is positioned relative to the retaining member 32 so that each of the retaining fingers 200*a* is inserted into the first portion 232 of the respective recess 222 in the base member 10*b*. The retaining member 32 is then rotated relative to the base member 10*b* so that each of the retaining fingers 200 is captured by the second portion 242 of the respective recess.

FIG. 7 schematically illustrates a cross-sectional view of the retaining member 32 and the base member 10*b* of FIG. 6 engaged with one another so as to capture the support member 25 therebetween. The configuration of the support member 25 shown in FIG. 7 is substantially similar to the configuration of the support member 25 described herein above with respect to FIGS. 1-3. As can be seen in FIG. 7, the inner ring portion 182 of the retaining member 32 captures the outer lip 120 of the support member 25 so that at least a portion of a lower surface of the inner ring portion 182 is disposed in an adjoining relationship with the upper surface of the outer lip 120. The cross-sectional view in FIG. 7 also shows the retaining finger 200*a* (see also FIG. 6) extending downwardly from the wall portion 192 of the retaining member 32 to the inwardly projecting portion 204. As illustrated in FIG. 7, the inwardly projecting portion 204 abuts the upper surface of the outwardly projecting flange 252 of the base member 10*b*. The flange 252 thus prevents the retaining member 32 from disengaging from the base member 10*b*.

Figure 8:
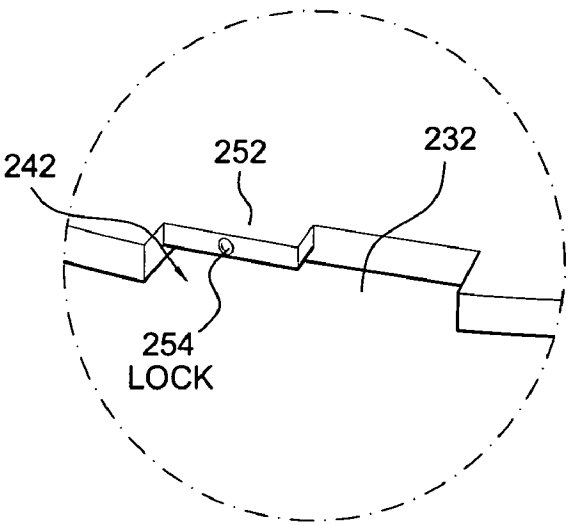
FIG. 8 shows an enlarged view of a recess in the base member circled as "A" in FIG. 6.

In certain embodiments, the outwardly projecting flange 252 may also include a locking projection 254 on a surface which comes into contact with the respective retaining finger 200*a*. FIG. 8 shows an enlarged view of the recess 222 circled as "A" in FIG. 6, and illustrates an example of the locking projection 254 formed on an outwardly facing surface of the flange 252. In other embodiments, the projection 254 may be formed on the lower surface of the flange 252. As shown, the locking projection 254 has a rounded shape so as to permit the respective retaining finger 200*a* to be passed over it when the support member 32 is rotated relative to the base member 10*b*. The locking projection 254 functions to increase the resistance or friction between the abutting surfaces of the flange 252 and the respective retaining finger 200*a* when the retaining member 32 is engaged with the base member 10*b*.

In certain embodiments, each of the retaining fingers 200*a* includes an indentation sized so as to accommodate the locking projection 254 and located on a predetermined surface of the retaining finger 200*a* and at position so as to align with the locking projection 254 when the retaining member 32 is engaged with the base member 10*b*. For example, each of the retaining fingers 200*a* may include an indentation on an inner surface of the wall portion 203 to accommodate the locking projection 254 shown in FIG. 8. In the alternative, the indentation may be located on an upper surface of the inwardly projecting portion 204 of the retaining finger 200*a* to accommodate the locking projection 254 located on the lower surface of the flange 252. While a rounded locking projection 254 is illustrated in FIG. 8, in certain embodiments this is replaced by a locking projection having a square or rectangular cross section or other cross-sectional shape.

In other embodiments, the flange 252 includes an indentation sized so as to accommodate the locking projection 254 formed on a predetermined surface of the retaining finger 200*a*. In certain illustrative embodiments, the locking projection 254 is formed on an inner surface of the wall portion 203, while the indentation adapted to accommodate the locking projection 254 is located on the outwardly facing surface of the flange 252. In the alternative, the locking projection 254 may be located on an upper surface of the inwardly projecting portion 204 of the retaining finger 200*a* and is accommodated by the indentation located on the lower surface of the flange

252. The shape of the locking projection 254 may vary and is preferably curved so as to allow the retaining finger to pass over the flange.

Referring now to FIG. 7, in certain embodiments the base member 10*b* includes a raised platform 11 surrounding the post 10*b* formed on the upper surface of the base member 10*b*. In an assembled state illustrated in FIG. 7, this raised platform 11 supports the lowermost edge 24 of the bushing 22. In the illustrative configuration shown in FIG. 7, the length of the bushing 22 is such that the lowermost edge 24 does not extend beyond a lowermost surface of the medial ring portion 110, i.e. a lowermost edge of the outer lip 120. In this way, when the support member 25 is placed on a substantially flat surface, it is supported by at least the lowermost edge of its outer lip 120, and not only by the lowermost edge 24 of the bushing. In a configuration where the length of the bushing is such that its lowermost edge 24 is aligned with the lowermost edge of the outer lip 120, the support member 25 is supported by both the lowermost edge of the outer lip 120 and the lowermost edge 24 of the bushing 22 when it is placed on a substantially flat surface. Such configurations provide additional support and balance to the support member 25 when a user displays a representational figure (not shown for purposes of simplicity and clarity) on the support member 25. When the support member 25 is captured by the retaining member 32 and the base member 10*b* as shown in FIG. 7, the upper surface of the medial ring portion 110, which may include game related indicia as described herein above with respect to FIGS. 1 and 2, is preferably aligned with an upper surface of the inner ring portion 182, which may include the index indicator as described above. In this way, a determination as to which attack parameter of the game related indicia is registered with the index indicator can be easily made by the user. In addition, as shown in FIG. 7, the lower surface of the outer lip 120 of the support member 25 is raised above the upper surface of the base member 10*b* so that the medial ring portion 110 is not in contact with the upper surface of the base member 10*b*. Such illustrative construction minimizes friction between the base member 10*b* and the support member 25 when the support member 25 is rotated relative to the base member 10*b*. In the other illustrative configuration, the length of the bushing 22 of the support member 25 may be adjusted so that the lowermost edge 24 of the bushing extends beyond the lowermost surface of the medial ring 110, i.e. lowermost surface of the outer lip 120 and such that when the support member 25 is used with the base member 10*b* illustrated in FIGS. 2 and 4, the lowermost surface of the medial ring portion 110, i.e. the outer lip 120, is slightly raised above the upper surface of the base member 10*b*.

Although not shown for purposes of clarity and simplicity, the base member 10*b* may be formed from a transparent or translucent material and the game indicia may be provided on the upper surface of the medial ring portion 110 as well as on the lower surface of the medial ring portion 110. In this way, the game indicia on the lower surface of the medial ring portion 110 is visible through the transparent or translucent base member 10*b* when the support member 25 is captured by the base 10. In certain embodiments, the game related indicia for determining the result of attacking, as described in more detail herein below, is provided on the upper surface of the medial ring portion 110, while other game related indicia, such as character information about the game piece, is provided on the lower surface of the medial ring portion 110. Character information may include, but is not limited to, the name and dimensions, e.g. length and weight, of the representational figure 130 mounted on the support member 25, and a collector number and rarity indicia for identifying the number of the representational figure 130 and its popularity or rarity. Character information may also include evolution indicia to assist the players in determining which family of representational figures the game piece belongs to and for determining a "chain of evolution" when the game piece is "evolved" as described in more detail herein below.

The game piece 20 described above can be used in a game for two or more players. In certain embodiments, the game comprises the steps of each player selecting a predetermined number of pieces 20 from a plurality of pieces and each player executing a turn. During a player's turn, the player has an option of at least one of moving one of the player's selected pieces from one location to another, and attacking one of another player's selected pieces using the player's selected piece.

In certain embodiments, when a player executes a turn wherein the player uses one of his or her pieces to attack one of the other player's pieces, the result of the attack is determined by the player performing a predetermined action using the piece he or she used for the attack, i.e. the attacking piece, and the other player performing the predetermined action using the piece which was attacked, i.e. the defending piece. In certain embodiments, the predetermined action performed by the player and the other player comprises spinning the attacking piece and the defending piece, respectively, by applying a force to the respective piece 20 so as to rotate the respective piece's support member 25 relative to the base 10. The effect of the attack will depend on the results of the two spins.

When a player chooses the option to move one of the player's pieces from one location to another, the piece may be moved along a desired path of movement, such as to approach an opposing player's piece, unless the desired path of movement of the piece is blocked by another piece. In certain embodiments, the player's piece may be required to be adjacent to the other player's piece in order to attack that piece, and thus, movement of the player's piece may be required so as to approach the other player's piece. In certain embodiments, the distance by which a piece may be moved during the player's turn may be limited and the maximum allowed distance per turn may vary from one piece to another. For example, the maximum distance by which a piece may be moved during the player's turn may be included in the game related indicia 140 displayed on the game piece 20.

After the player completes executing his or her turn, another player can then execute a turn wherein this player has the same or similar options as the first or previous player had during his or her turn.

In certain embodiments, when the player executes a turn, the player has an option of at least one of moving one of the player's pieces from one location to another, and attacking one of the opposing player's pieces, wherein the attacking is executed by rotating the support member 25 relative to the base 10 of at least one of the attacking piece and the defending piece. The effect of the attack will depend on the result of the rotation and can be determined by the game related indicia 140 registered with the index indicator 260 when the support member 25 of the respective piece 20 comes to rest.

When such rotation, or spinning, of the piece 20 is used to determine the effect of the attack by the attacking piece, the strength and nature of the attack will be indicated by the section 150, 160 of the game related indicia 140 that comes to rest opposite the index indicator 260, or the pointer, following the spinning of at least one of the attacking piece and the defending piece. The nature and the strength of the defense of the defending piece can be similarly indicated by the section 150, 160 of the game related indicia 140 representing one or more attack parameters that comes to rest opposite the index indicator 260. In an embodiment where both the attacking piece and the defending piece are rotated or spun to determine the effect of the attack by the attacking piece, the strength and nature of the attack will typically be determined by the result of the spinning of the attacking piece and the strength and nature of the defense will be determined by the result of the spinning of the defending piece. In an embodiment where only one of the attacking piece and the defending piece is rotated or spun to determine the effect of the attack, the strength and nature of one of the attack or of the defense will be determined by the result of such spinning, while the strength and nature of the other of the attack or defense may be pre-defined by an indicia on the respective piece, or by the players or the rules of the game.

If, as a result of the predetermined action performed by one or more players as described above, it is determined that the defending piece suffers more damage than the attacking figure, the defending piece is defeated or "knocked out." A defeated piece may be permanently or temporarily removed from the game. The amount of damage suffered by each piece due to the attack is determined by the number of points assigned to the attack by each piece's attack. In certain embodiments, a player's piece may also be defeated and removed from the game if it is surrounded by the opponent's pieces so as to prevent the player from moving that piece from one location to another.

As described above, in some embodiments the game related indicia 140 of the game piece 20 comprises one or more attack parameters. In certain embodiments, one or more of the attack parameters may represent a condition which allows the piece with such attack parameter to disable an opponent's game piece without defeating the opponent's piece, when such attack parameter is selected, e.g. by spinning. In particular, the nature of the disability represented by the condition attack parameter can be indicated by one or more sections 150, 160 of the game related indicia 140, and the condition attack parameter is selected when the section representing such parameter comes to rest opposite the index indicator after spinning the piece. The condition attack parameters may include, but are not limited to, "asleep," "burned," "confused," "frozen," "paralyze," "wait" and "poisoned," and the effect of the disability attack parameters may vary but can include an inability or a reduced ability of the affected piece to attack or defend on a subsequent turn. For example, a piece which is "asleep," "wait" or "frozen" may be unable to attack and/or move from one location to another, while a piece which is "paralyzed," "burned" or "poisoned" may have reduced attacking capabilities. In another example, if a piece is affected by a "confused" condition, a different attack parameter may be selected than the parameter resting opposite the index indicator after spinning the affected piece. A piece disabled by another piece as a result of an attack can be marked or labeled, such as by placing a collar or other form of indicia around the disabled piece indicating the nature of the disability or condition.

In this illustrative embodiment, the method of playing a game for two or more players comprises steps of each player selecting a predetermined number of first character items from a plurality of first character items and at least one second character item from a plurality of second character items, each player selecting game items including a predetermined number of second character game items comprising instructions for use with the second character items, and each player executing a turn, wherein the player has one of a first option and a second option. In some embodiments, each of the game items for use with the second character items may be assigned a point value and the maximum number of such game items that can be selected by each player may depend on a total maximum allowable point value of the second character game items selected by each user.

In this embodiment, the first option for executing the player's turn comprises at least one of moving one of the player's selected first character items from one location to another and attacking one of another player's selected first character items using the player's selected first character item. The first option may be performed in a similar fashion as in other embodiments described above. The second option comprises using the player's selected second character item with one of the player's selected game items for use with the second character item, and executing instructions on the game item. The first and second character items may be in the form of one or more of trading cards, game pieces as described above, or any other suitable form. In certain embodiments, the first character items represent a variety of playing characters, while the second character items represent trainer or instructor characters. The characteristics and capabilities of the first character items are different from those of the second character items. For example, in some embodiments, the first character items may be moved and used to attack other character items, while the second character items are stationary and may be used only together with the game item that provides instructions for use of the second character item. The game items for use with the second character items may be in the form of trading cards or any other suitable form. These game items include game items which may be used with any of the second character items and game items which may be used only with one or more designated second character items.

In certain embodiments, the method of playing a game may comprise a step of the player executing a turn, wherein the player has an option of performing a predetermined action using the player's second character item to determine whether the game item for use with the second character item is activated, and if the game item is activated, executing instructions provided on the activated game item. If the game item is not activated, the player's turn ends and another player has a chance to execute a turn wherein another player has the same or similar options as the first or previous player during that player's turn.

In an embodiment where the second character item is in the form of a game piece, the predetermined action to determine whether the game item is activated may comprise spinning the second character piece by causing the support member of the piece to rotate with respect to its base. In this illustrative case, the game related indicia of the second character piece includes at least two parameters, wherein a first parameter indicates a success in activating the game item and a second parameter indicates a failure in activating the second character item. Whether or not the second character game item is activated is dependent on the position of the game related indicia when the support member stops rotating with respect to the base of the second character piece. In particular, the parameter which rests opposite the index indicator when the support member stops rotating determines whether the game item is activated. If the game item is activated, the player executes instructions indicated on the game item and disposes of the game item after it has been used. In certain embodiments, the game item may be marked such as by marking the game item or by changing the position of the game item while the game item is in use.

Figure 9:
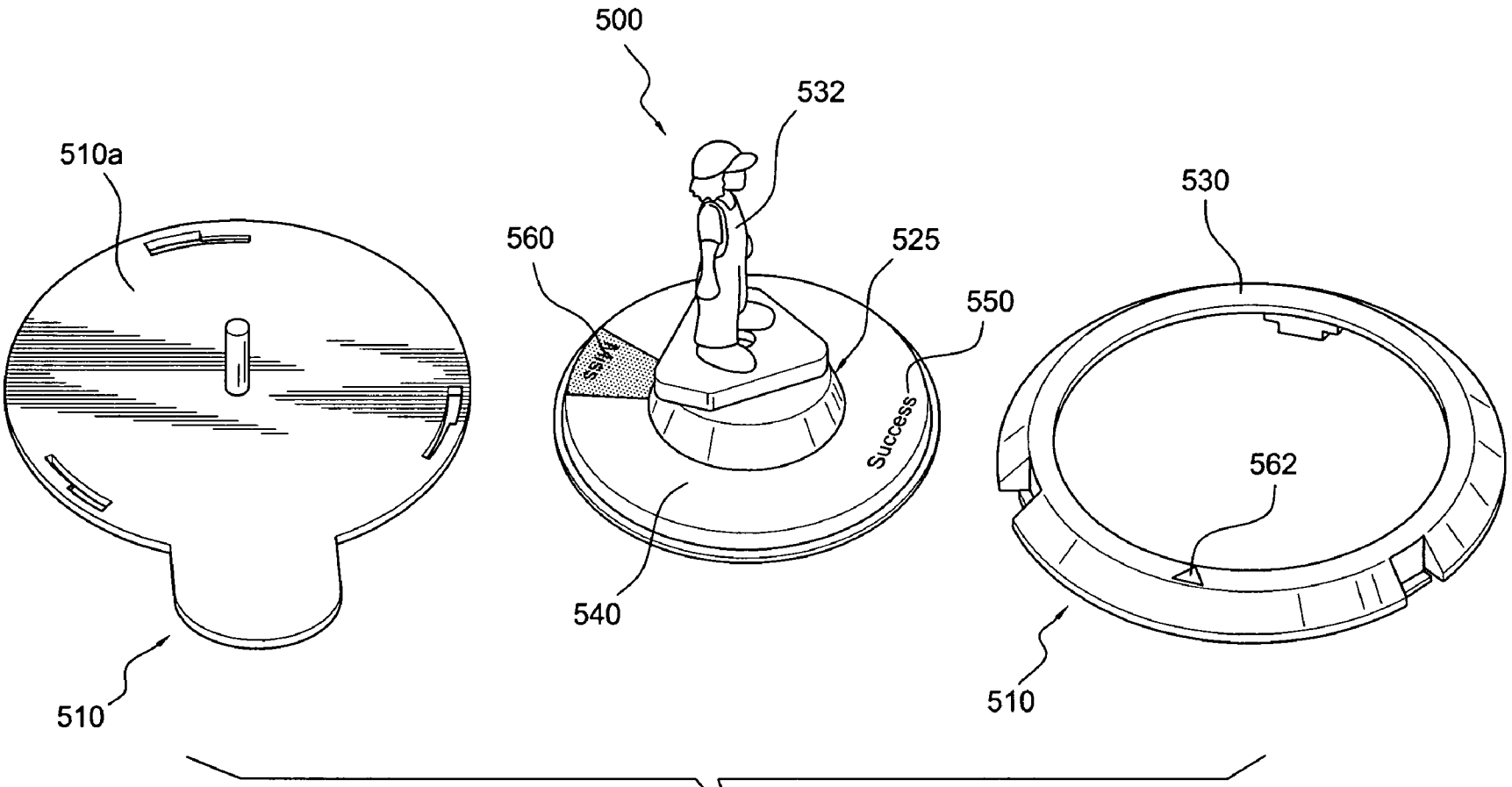
FIG. 9 shows an illustrative example of a second character game piece.

FIG. 9 shows an illustrative example of the second character game piece 500. As illustratively shown in FIG. 9, the construction of the second character game piece 500 is similar to the construction of the game piece 20 shown in FIG. 2 or FIGS. 6-8, and therefore, detailed description of the same features is omitted. As shown, the second character game piece 500 includes a support member 525 and a base 510. The base 510 includes a base member 510*a* and a retaining member 530 adapted to engage with the base member 510*a* so as to capture the support member 525 and to allow the support member 525 to freely rotate with respect to the base 510. The support member 525 supports a representational figure 532 representing the second character. The game piece 500 also includes an index indicator 562 and game related indicia 540 which includes a first section 550 representing success (in this case labeled "Success") in activating a game item for use with the piece 500 and a second section 560 representing failure (in this case labeled "Miss") in activating the game item. In this illustrative embodiment, the game related indicia 540 is in a form of a sticker affixed to the support member 525 and the index indicator 562 is in the form of an arrow or a pointer provided on the retaining member 530 of the base 510. As described above, the piece 500 is spun by rotating the support member 525 with respect to the base 510 so as to cause the game related indicia 540 to rotate with respect to the index indicator 562. When the support member 525 comes to a stop after being rotated, that section 550, 560 which is registered with, or opposite, the index indicator 562 is selected to represent the determination as to whether the game item is activated.

In certain embodiments, the method of playing a game for two or more players further includes a step of using a deciding character, which may be represented by a deciding piece, such as a judge piece. The deciding character may be used to decide a variety of issues, such as which player takes the first turn or to settle a disagreement or a challenge between two or more players.

In an illustrative embodiment, the deciding character piece has a similar construction as the game piece 20 described above and includes game related indicia representing at least a first deciding option and a second deciding option. The first and second deciding options may be shown as different color sections, such as a dark section and a light section. One way of using the deciding piece is to have one player spin the deciding piece to cause the support member of the deciding piece to rotate relative to the base, while the other player selects a section of the game related indicia to represent his or her position or side. For example, to determine which player takes the first turn, one player can spin the deciding piece while the other player can select the section of the game related indicia, and if, when the deciding piece comes to rest, the index indicator points to the section selected by the player, the selecting player takes the first turn. Otherwise, the spinning player takes the first turn. In another example, the deciding piece may also be used to determine whether a player should spin the player's character piece again if a previous spin of the player's character piece lasted less than a predetermined number of seconds or made less than a predetermined number of rotations.

An illustrative example of a game for two or more players which employs the game pieces 20, 500, the steps described above and a method of playing the same will now be described. In an illustrative embodiment, the game comprises a plurality of game pieces, each of which represents a character and a field of play. In playing the game, each player selects a predetermined number of game pieces and has an option of using one or more of his or her selected game pieces during his or her turn to attack one or more game pieces of an opposing player. The object of the game can be one of the following: defeating all of opposing player's game pieces and/or disabling all of the opposing player's game pieces so that the opposing player is unable to execute a turn, or receiving a predetermined number of points and/or reaching a predetermined goal or location on the field of play.

In certain embodiments, the field of play includes a play area in which the players can move the game pieces from one location to another and can attack opposing players' game pieces. The field of play may also include peripheral areas which may be used to provide spaces for each player's selected game pieces. In certain embodiments, the field of play also includes a holding area where defeated game pieces are placed. In particular, the holding area may have a limited capacity and, if the holding area has reached its maximum capacity, one of the game pieces in the holding area is removed therefrom before another defeated game piece is placed into this area. The holding area may be located in one or more of the peripheral areas of the field of play.

Figure 10:
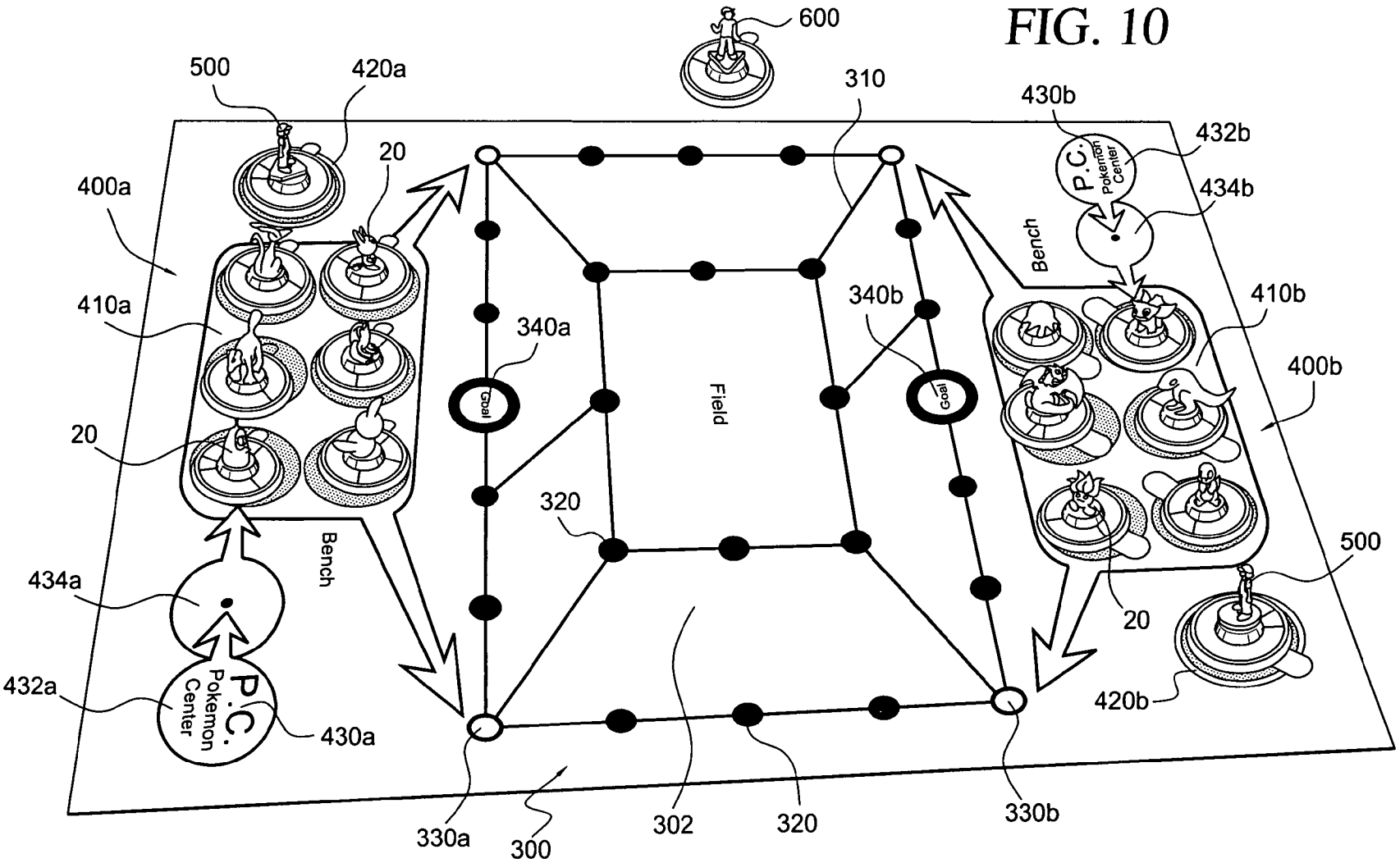
FIG. 10 shows an illustrative example of a playmat for a two-player game.

In certain embodiments the field of play is in a form of a playmat. In the alternative, the field of play is in the form of a game board. An illustrative example of a playmat 300 for a two-player game is shown in FIG. 10. As shown, the playmat 300 includes a play area 302 marked as "Field" and a peripheral area for each of the players. In this case, the playmat 300 includes a first peripheral area 400*a* that can be used by one of the players and a second peripheral area 400*b* which can be used by the other player. The play area 302 includes a plurality of field positions 320 joined by a plurality of pathways 310. The field positions 320 represent permissible stationary positions for the game pieces 20 in the play area 302. The pathways 310 represent permissible paths for moving the game pieces from one field position 320 to another.

As shown in FIG. 10, the field positions 320 may include special types of field positions 320, including entry positions 330*a*, 330*b* and goal positions 340*a*, 340*b*. Entry positions 330*a*, 330*b* represent positions, or entry points, on the play area 302 at which a player may have his or her game pieces 20, or character pieces, enter the play area 302. In this illustrative example, two entry positions 330*a* are provided adjacent the first peripheral area 400*a* and two entry positions 330*b* are provided adjacent the second peripheral area 400*b*. The goal positions 340*a*, 340*b* represent the position that one of the opposing player's character items or pieces has to reach in order to win the game. The goal position 340*a* is provided adjacent the first peripheral area 400*a* at a location between the entry positions 330*a* and represents the goal position that a player starting from the peripheral area 400*b* needs to reach using one of his or her character pieces in order to win the game. The goal position 340*b* is provided adjacent the second peripheral area 400*b* at a location between the entry positions 330*b* and represents the goal position that the other player starting from the peripheral area 400*a* needs to reach using one of his or her character pieces. It is understood that the locations of the entry positions 330*a*, 330*b* and of the goal positions 340*a*, 340*b* on the play area 302 are not limited to those shown in FIG. 10 and may vary depending on the design of the play area 302. It is also understood that the arrangement of the pathways 310 between the field positions 320 may also vary and is not limited to the arrangement shown in FIG. 10.

Figure 11:
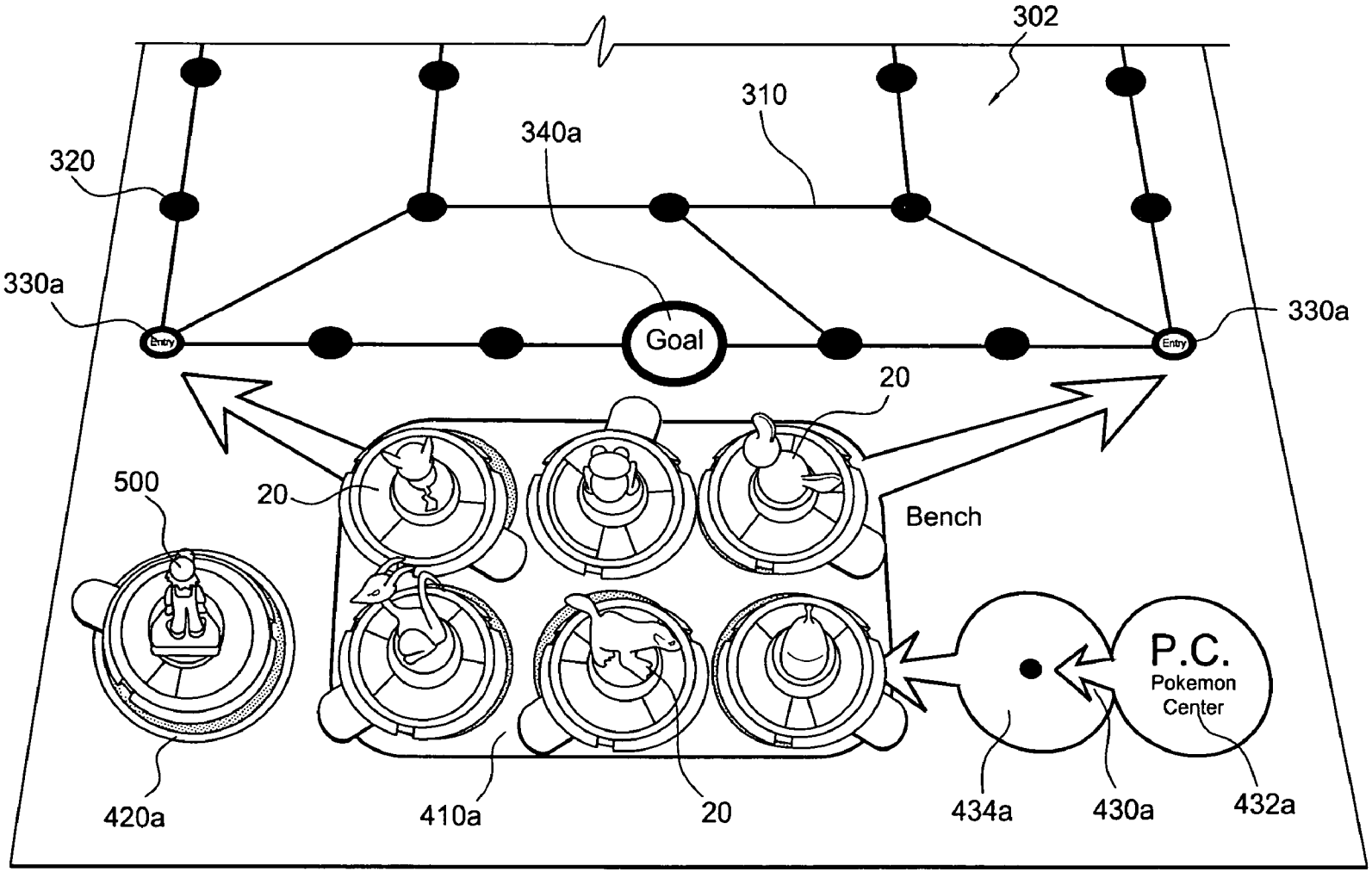
FIG. 11 shows a more detailed view of one of peripheral areas of the playmat of FIG. 10.

As also illustratively shown in FIG. 10, each peripheral area 400*a*, 400*b* of the field of play 300 includes a starting section 410*a*, 410*b* labeled as "Bench" in FIG. 10. FIG. 11 shows a more detailed view of one of the peripheral areas 400*a* of the field of play 300.

As shown in FIG. 10, each starting section 410*a*, 410*b* is designed to hold the character items or game pieces 20 selected by the respective player. The starting section 410*a*, 410*b* may have a limited capacity. For example, each starting section 410*a*, 410*b* shown in FIG. 10 has the capacity to hold a maximum of six pieces 20. As described in more detail herein below, each player may move one of his or her pieces from the player's respective starting section 410*a*, 410*b* to the respective entry position 330*a*, 330*b*, when executing his or her turn in the game, so that the piece 20 enters the play area 302.

Each of the peripheral areas 400*a*, 400*b* may include a separate area for placing or holding the second character item, such as a trainer piece 500. As shown in FIG. 10, each peripheral area 400*a*, 400*b* includes a trainer space 420*a*, 420*b* for accommodating the respective player's trainer piece 500. As discussed above, the trainer piece 500 can be used in the game together with a game item which includes instructions for its use with the trainer piece 500. In this illustrative embodiment, the game items for use with the trainer pieces 500 comprise a plurality of cards, also referred to as trainer cards, each of which provides instructions for using the trainer piece.

As mentioned above, each of the peripheral areas 400*a*, 400*b* may also include a holding area 430*a*, 430*b* having a limited capacity for holding defeated or removed character pieces 20. As shown, each peripheral area 400*a*, 400*b* includes a holding area 430*a*, 430*b*, labeled as "Pokemon Center," which includes two spaces 432*a*, 434*a*, 432*b*, 434*b* for accommodating a maximum of two defeated character pieces. When a player's piece is defeated, it is first placed in the first space 432*a*, 432*b* of the player's respective holding area 430*a*, 430*b*. If another piece is already present in the first space 432*a*, 432*b*, that piece is moved into the second space 434*a*, 434*b* of the player's respective holding area 430*a*, 430*b*. If, when a player's piece is defeated, the player's respective holding area 430*a*, 430*b* is already holding two defeated pieces, the piece which is in the second space 434*a*, 434*b* is removed from the holding area 430*a*, 430*b* and returned to the player's respective starting area 410*a*, 410*b*. In this case, the piece which is located in the first space 432*a*, 432*b* is moved into the respective second space 434*a*, 434*b*, so that the newly defeated piece can be placed in the respective first space 432*a*, 432*b* of the holding area 430*a*, 430*b*.

Although not shown for purposes of simplicity and clarity in FIGS. 10 and 11, the peripheral areas 400*a*, 400*b* may be designed so as to also include a space for accommodating each of the player's trainer cards. In some embodiments, the field of play 300 also includes a separate area for accommodating the deciding piece 600, such as the judge piece.

An illustrative method of playing a game using the above-described pieces 20, 500, 600, game items and playmat 300 will now be described. In this illustrative case, the game is played by two users or players, wherein a first player uses the first peripheral area 400*a* and a second player uses the second peripheral area 400*b*. Before taking turns, each of the players chooses a predetermined number of game pieces 20 representing the player's characters and a second character piece 500 representing the trainer piece. In this illustrative case, the maximum number of game pieces 20 that each player can choose is six pieces 20 corresponding to the capacity of the starting area 410*a*, 410*b* for each player. Each player then places his or her selected character pieces 20 on the spaces provided in his or her starting area 410*a*, 410*b* and also places his or her trainer piece 500 on the respective trainer space 420*a*, 420*b*. In certain embodiments of the invention, each player's game pieces 20 may be identified by a predetermined indicia or color. For example, if game pieces 20 shown in FIGS. 1-9 are used by the players, each player's game pieces 20 can be identified by a predetermined color of the base 10 of each of the game pieces 20. That is, the base 10 of one player's game pieces 20 has a different color than the base 10 of the other players' game pieces 20. Thus, the base 10 of each game piece 20 used by a user should have the same color as the base 10 of each of the other game pieces 20 used by that user.

Each of the players also selects game items, including a predetermined number of trainer cards. The maximum allowable number of trainer cards per player may also depend on the point value of the cards selected by each player. For example, the trainer cards may include trainer cards having a point value of 50 and trainer cards having a point value of 100, and each player may be allowed to select trainer cards totaling a maximum of 300 points.

In certain embodiments, one or more of a player's character pieces may be evolved or exchanged for a character piece having more advanced or superior attack parameters, e.g. attack parameters having higher strength values. In such embodiments, each player is allowed to select up to three "evolved" character pieces and place them on a side of the field of play 300. In the alternative, a marker item may be used to show that a character piece is "evolved." The player's selected "evolved" character pieces should correspond to the player's selected character pieces, such that each of the selected "evolved" character pieces is from the same "chain of evolution" as at least one of the selected character pieces. In certain embodiments, a player's character piece can be evolved if that piece defeats one of opponent's character pieces in a battle.

In certain embodiments, evolution of a character piece affects the attack parameters of that piece. For example, if a character piece is evolved after defeating one of the opposing character pieces, the strength value for each of the attack parameters of the evolved piece is increased by 10 points, and if this character piece is evolved again later in the game, then the strength value of each attack parameter is again increased by 10 points.

After the players select their respective character pieces, trainer pieces and game items, the game is played by each player taking a turn. The object of the game is to reach the opposing player's goal position 340*a*, 340*b*, which is adjacent to the opposing player's peripheral area 400*a*, 400*b*. In order to determine which player will take the first turn, the deciding piece, also referred to as the judge piece 600, can be used. As discussed above, one of the players spins the judge piece 600 by rotating its support member with respect to its the base, while the other player selects a section of the game related indicia on the support member of judge piece 600. If the section selected by the other player is registered with the index indicator on the base of the judge piece 600 when the support member stops rotating, then the selecting player takes the first turn. If, however, the selected section is not registered with the index indicator when the support member stops rotating, then the spinning player takes the first turn.

When a player takes a turn, the player has an option of selecting a character piece 20 from the player's starting area 410*a*, 410*b* and moving the piece to the play area 302 via one of the entry positions 330*a*, 330*b* adjacent that player's starting area 410*a*, 410*b*. If the player already has one or more character pieces in the play area 302, the player may instead choose to move one of those character pieces from one field position to another. As discussed above, the game related indicia 140 on the game piece may include the allowable distance, or the number of moving points, that the piece can travel during the player's turn. The moving points indicated on the piece being moved will determine the maximum distance, or number of field positions 320, that the piece may move during the player's turn. For example, if a piece has one moving point, then it can only be moved from one field position to an adjacent field position connected by a pathway 310. When the player moves one of the character pieces from his or her respective starting area 410*a*, 410*b*, the character piece being moved is required to have at least one moving point to enter the play area 302 at the respective entry position 330*a*, 330*b*, and any moving points remaining after the piece is placed on the entry position can be used to move the piece further through the play area 302. In this illustrative embodiment, a character piece 20 is not permitted to move to a field position 320 which is already taken up by another character piece 20 or move through a field position 320 which is taken up by another piece. Thus, for example, if an entry position 330*a*, 330*b* is taken up by a character piece, another character piece will not be permitted to enter the play area 302 using that entry position 330*a*, 330*b*. Such blocking of a character piece's movement may in some cases be used to "knock out" or defeat one of opposing player's pieces. In particular, in this illustrative game, a character piece can be defeated, and thereafter removed to the holding area, if it is surrounded by the opposing player's pieces blocking it from moving in any direction. In certain embodiments, such blocking technique may supersede a player's movement of his or her character piece into the goal position. In particular, if a player moves his or her character piece into the goal position, but that character piece is surrounded by opposing player's character pieces, then the surrounded character piece is removed into the holding area, rather than the player winning the game.

During his or her turn, the player may also have an option of using one of his or her character pieces to attack one of the opposing player's character pieces. This option may be limited by the location of the player's pieces on the play area 302. In particular, the player may be required to first move the character piece before using that piece to attack an opposing player's character piece. Moreover, in some embodiments, the player's attacking character piece may be required to be in a field position adjacent to the field position of the opponent's character piece before it can attack the opponent's character piece. In certain embodiments, however, the player may be able to use his or her character piece to execute a long-range attack against an opponent's character piece from predetermined distance. The maximum allowable distance and the strength value for the long-range attack may be provided by the game related indicia 140 on the player's character piece 20.

When the player uses one of his or her pieces, i.e. attacking piece, to attack the opponent's character piece, i.e. defending piece, the player spins the attacking piece as described above while the opponent spins the defending piece. The effect of the attack is determined by the results of the spins. If the result of the spin of one of the defending piece and the attacking piece cannot be determined, such as when the index indicator registers with a line dividing two attack parameters, the judge piece 600 may be used to determine the result of the spin. In the alternative, one or both players may be allowed to spin their respective pieces again.

In certain embodiments, only the attacking piece is spun. For example, if the player uses one of his or her character piece for a long-range attack against one of the opponent's pieces and the opponent's defending piece's long-range attack strength value is zero, then only the attacking piece is spun to determine whether the long-range attack is successful.

In certain embodiments, the type of each attack parameter on the game related indicia of the character piece may be represented by a color which defines priority of that attack parameter relative to the other types of attack parameters. An attack parameter with a higher priority will defeat an attack parameter with a lower priority. In this illustrative example, the attack parameters are represented by four different colors, having priorities from the highest to the lowest as follows: a first color represents an attack parameter having the highest priority and supersedes all other types of attack parameters, a second color represents a condition attack parameter with a predetermined strength value which has a higher priority than, and supersedes, an attack parameter of a third color, but a lower priority than the attack parameter represented by the first color, a third color represents an ordinary attack parameter having a predetermined strength value, and a fourth color represents a missed attack, i.e. "miss," having the lowest priority.

If the spinning of the attacking and the defending pieces results in two ordinary attack parameters of the third color being selected, then the piece with a higher strength value for the selected attack parameter wins the battle, and the piece which has a lower strength value for the selected parameter is defeated. Similarly, if the spinning of the pieces results in two attack parameters of the second color being selected, then the piece which has a higher strength value for the selected attack parameter wins the battle. If the spinning of the attacking and defending pieces results in the parameter of the first color being selected on the attacking piece and the parameter of the second or third color being selected on the defending piece, then neither piece is affected as a result of the attack unless the first color includes additional instructions, which then result. If the strength values of both selected parameters are the same, then the result of the attack is a draw. If the spinning of the attacking piece and the defending piece results in two attack parameters of the first color being selected, then the result of the attack is a draw. Finally, if both of the selected attack parameters are of the fourth color, then the result of the attack is a draw. When the result of the attack is a draw, then neither the attacking piece nor the defending piece is affected or damaged.

In certain embodiments, the attack parameter having the second color may include instructions for one or more actions to be performed by the player of the game piece. If the spinning of the attacking figure results in the parameter of the second color being selected and the spinning of the defending figure results in the parameter of the third color or the fourth color being selected, then the player of the attacking figure must perform as instructed by the selected attack parameter of the second color. If the spinning results in the parameter of the second color being selected on the defending figure and the parameter of the third or fourth color being selected on the attacking figure, then the player of the defending figure must perform whatever is instructed by the parameter of the selected second color parameter. If the spinning results in the parameter of the second color being selected on both the attacking figure and the defending figure, then the player whose selected parameter has a higher strength value must perform as instructed by the selected parameter of the second color.

In certain embodiments, the attack parameter of the third color may also include one or more conditions and/or instructions for affecting the one or more conditions in addition to the strength value. For example, game related indicia on a game piece may include an attack parameter of the third color which has a predetermined strength value of the attack and instructions that if the game piece is defeated, then the defending game piece becomes affected by a predetermined condition. It is understood that the instructions and the conditions may vary from one game piece to another.

Although this illustrative example describes four colors as defining the priorities of attack parameters, it is understood that a different number of colors may be used. Also, indicia other than colors can be used to define the priorities of attack parameters. Moreover, special indicia may be used to represent an attack parameter having a varying priority. In this example, a fifth color is used as the special indicia for attack parameters which have a higher priority than the attack parameters of the second color, but are treated as ordinary attack parameters, i.e. of the third color, relative to all other types of attack parameters.

As described above, attack parameters indicated by the game related indicia 140 on the character pieces 20 may include one or more attack parameters representing a condition. Such condition attack parameters, when selected as a result of spinning the respective piece, are used to disable the opponent's character piece without defeating the opponent's piece. The disability of an affected character piece may be indicated by condition indicia which represents the condition by which the character piece is affected. Such condition indicia may be in the form of a collar which indicates the name of the condition and is placed on or around the affected piece.

In this illustrative example, the condition attack parameters include "asleep," "burned," "confused," "frozen," "paralyze" and "poisoned" conditions, each of which has a different disabling effect on the character piece affected thereby. In this illustrative example, a character piece can be affected by only one condition at any particular time, so that a subsequent condition replaces any condition which already affects the character piece. When a character piece affected by a condition is defeated and placed into the holding area, that character piece continues to be affected by the condition until it is removed from the holding area and is moved to the starting area, as described in more detail below. Moreover, if a character affected by a condition is evolved as described above, the condition is removed from the "evolved" character.

The specific conditions that can affect a character piece in certain embodiments will now be described. If a character piece is affected by the condition "asleep," such character piece cannot move or attack during the respective player's turn, and cannot be used for blocking movement of other character pieces in the play area 302 or to surround an opponent's character piece. The "asleep" condition can be removed by the player moving another one of his character pieces to come in contact with the piece affected by the "asleep" condition, in which case, the player's turn ends immediately after this condition is removed. The "asleep" condition is also removed from the affected character piece when the opposing player uses one of his or her pieces to attack the affected character piece. The condition "burned" has a negative effect on the attack abilities of the affected character piece. In particular, before the "burned" character piece is spun so as to select an attack parameter, one of the attack parameters is replaced with a "Miss" attack parameter which has no effect on the opposing character. In addition, the strength value of any attack parameter selected as a result of the spinning of the "burned" character piece is reduced by a predetermined number of points, e.g. 10 points. If a character piece is affected by a "confused" condition, then a different attack parameter than the attack parameter registered with the index indicator, is selected as the result of spinning of the affected piece. For example, if a first attack parameter is registered with the index indicator when the "confused" character piece comes to a stop, the player has to move the game related indicia of the "confused" piece in a predetermined direction so that an adjacent attack parameter is selected as the result of the spin instead of the first attack parameter. If a character piece is affected by the "frozen" condition, then its attacking ability is affected so that the selected attack parameter is always a "miss" attack parameter. If a character piece is affected by the "paralyze" or the "poisoned" condition, then its attacking ability is affected so that the strength value of any attack parameter selected as a result of the spinning is reduced by a predetermined number of points, e.g. 20 points if a piece is "poisoned." In other embodiments, when a character piece is affected by the "paralyze" condition, one of the attack parameters is pre-selected by the player to be replaced with a "Miss" attack parameter which has no effect on the opposing character.

Although this illustrative example provides six conditions that can be represented by the attack parameters, it is understood that a greater or a smaller number of conditions can be used in the game. In addition, the effects and names of the conditions may vary depending on the rules and the design of the game. Thus, for example, the "asleep" condition may also be referred to as a "wait" condition. In certain embodiments, the attack parameters of a game piece may include a condition that has an effect of increasing or decreasing the strength value of one or more attack parameters of the game piece or of the opponent's game piece.

In certain embodiments, some of the character pieces may also possess one or more special abilities which can be represented by the game related indicia. For example, a special ability of a character piece may be represented by a border on the label 140 affixed to the support member 25 of the piece 20 and a description of the special ability within this border. In this illustrative example, if a piece possesses a special ability, this special ability will have priority over and will supersede any attack parameters selected during the attack.

In certain embodiments, the strength value of the selected parameter as a result of spinning the game piece may be increased if a predetermined requirement is satisfied after performing an additional predetermined action. In this illustrative example, the additional predetermined action is performing a further spin of the game piece and the predetermined requirement is selecting the same attack parameter as in the previous spin after performing the further spin. Namely, if the spinning of the game piece results in a first attack parameter being selected, then the strength value of the first attack parameter if increased if a further spinning of the game piece is performed and results in the same first attack parameter being selected. It is understood that in some embodiments, the additional predetermined action may be repeated so as to further increase the strength value of the selected attack parameter until the predetermined requirement for increasing the strength value is not satisfied.

If it is determined based on the spin results that one of the attacking piece and the defending piece has lost the battle, this defeated piece is temporarily removed from the game and is placed into the holding area 430*a*, 430*b* of its player. As described above, the holding area has a limited capacity and when the maximum capacity of the holding area is reached, one character piece must be removed from the holding area before a newly defeated piece is placed in this area. When a player removes a piece from the holding area, that piece is placed in the player's starting area. However, in some embodiments, this piece may not be immediately used by the player during his or her turn. For example, in this illustrative case, the player is not permitted to move any piece placed into the starting area from the holding area during the player's turn immediately following the piece's removal from the holding area.

In this illustrative example, instead of moving one of the character pieces or attacking the opposing player's piece, the player also has an option to use one of the player's selected trainer cards with the player's trainer piece 500 during his or her turn. If the player chooses to use one of the selected trainer cards, the player has to first notify the opposing player of the selected trainer card that the player intends to use and attempt to activate the selected trainer card before using it with the trainer piece 500. As discussed above, to activate the trainer card, the player may spin his or her trainer piece 500 so that the game indicia on the support member is rotated with respect to the index indicator on the base. If a parameter representing failure to activate the trainer card is registered with the index indicator when the support member comes to rest, then the selected trainer card is discarded and the player's turn ends. If a parameter representing successful activation of the trainer card is registered with the index indicator when the support member comes to rest, then the player has activated and may use the trainer card with the trainer piece 500. The trainer card is used by performing all of the instructions indicated on the trainer card. In certain embodiments, if the instructions on the trainer card are in conflict with a special ability of a character piece, then the trainer card instructions will supersede the special ability. To show that the trainer card is being used, the position of the trainer card may be changed or a marker may be placed on the trainer card. For example, trainer cards in use may be placed face down to indicate that they are being used. After the trainer card is used, it is removed from the game.

A player's turn ends after the player uses the trainer card, or after it is determined that the trainer card is not activated. If instead of using the trainer card with the trainer piece 500, the player selects at least one of moving one of the player's character pieces and attacking the opposing player's piece, the player's turn ends when this option, i.e. the moving and/or the attack, is completed. After the player's turn ends, the opposing player's turn begins, during which the opposing player has the same or similar options as the player.

The rules of the illustrative game described above may be modified by the players. For example, the game may include a "first piece entry rule," wherein the maximum allowable moving distance, or the moving points, of any character piece that enters the play area 302 first is reduced by a predetermined amount, e.g. 1 point. Moreover, during an attack, the players may be required to spin their respective pieces for a minimum predetermined period of time, e.g. 3 seconds, and if one or more of the pieces spins for less than the minimum predetermined period of time, the respective player may be required to re-spin his or her piece. Any decisions as to whether a player should re-spin his or her character piece 20 can be decided by the judge piece 600.

The rules of the game may also be modified to limit the time each player may spend on his or her turn, or the total amount of time that each player may spend on his or her combined turns. In the case where the total time of each player is limited, a chess clock may be used to regulate the turns of each player, and after a player's predetermined time expires, the player may be required to remove from the game all character pieces present in his or her respective holding area. In addition, after the expiration of the predetermined period of time, the game may be terminated and the players may determine the winner of the game based on the number of character pieces each player has remaining on the field of play 300, or based on the value of the total trainer cards that each player has remaining at the end of the game, or based on the total number of moving points that each player's character pieces have remaining at the end of the game.

In all cases it is understood that the above-described arrangements and methods are merely illustrative of the many possible specific embodiments which represent applications of the present invention. Numerous and varied other arrangements, including use of different materials and various configurations of components of the game pieces and the methods of playing the game, can be readily devised in accordance with the principles of the present invention without departing from the spirit and scope of the invention. For example, the game and the method of playing a game can be used with game pieces having varying constructions, which are not limited to the construction described herein above, or with other forms of game pieces including, but not limited to, trading cards. Moreover, the game pieces may be employed in other games such as sports games, e.g. baseball or football, adventure games, auto racing games or the like, and used with other methods of playing a game.

We claim:

1. A game piece for use by a player in a game or as a collectible figure, comprising:

an article of manufacture comprising a first portion comprising a representational figure; and a second portion affixed to the first portion; and a support structure;

wherein the second portion includes a central member having an upper surface, the representational figure being affixed to the upper surface, and a medial ring portion extending outwardly from the central member;

the second portion comprising a coupling member coupled with the support structure so that a user of the article of manufacture is enabled to couple it with the support structure and uncouple it therefrom, the coupling member comprising a mounting portion formed on a lower surface of the central member so that the mounting portion is mounted on a support portion formed on an upper surface of the support structure and so that the coupling member is arranged to rotate freely on the support structure;

the game piece further comprising indicia on one of the article of manufacture and the support structure representing a plurality of attack parameters usable in a preexisting game, said indicia being movable with respect to the other of the article of manufacture and the support structure in response to a force applied by a user, wherein selection of an attack parameter from said plurality of attack parameters is determined by a position at which said indicia rest after being moved by the user.

2. The game piece of claim 1, wherein the mounting portion has an inner surface adapted to fit closely over a post of the support structure having a substantially cylindrical shape.

3. The game piece of claim 2, wherein the mounting portion has a predetermined length such that a lowermost edge of the mounting portion is supported by an upper surface of the support structure.

4. The game piece of claim 3, wherein at least one of the coupling member and the support structure is formed from a molded plastic having a low friction surface.

5. The game piece of claim 4, wherein the molded plastic comprises molded ABS.

6. A game piece for use by a player in a game or as a collectible figure, comprising:

an article of manufacture comprising a first portion comprising a representational figure; and a second portion affixed to the first portion; and a support structure comprising a base and a retaining member releasably engaged with the base;

the second portion comprising a coupling member coupled with the support structure so that a user of the article of manufacture is enabled to couple it with the support structure and uncouple it therefrom;

wherein the retaining member includes a plurality of retainer fingers formed integrally with the retaining member and the base includes a plurality of recesses, the plurality of retainer fingers being arranged to engage with the respective recesses, the retaining member being rotatable relative to the base to releasably engage the retaining member with the base, wherein the coupling member is captured by the base and the retaining member so that the article of manufacture is freely rotatable on the support structure;

the game piece further comprising indicia on one of the article of manufacture and the support structure representing a plurality of attack parameters usable in a pre-existing game and an index indicator on the other one of the article of manufacture and the support structure, said indicia being movable with respect to the other of the article of manufacture and the support structure in response to a force applied by a user to register with the index indicator;

wherein selection of an attack parameter from said plurality of attack parameters is determined by a position at which said indicia rest after being moved by the user.

7. The game piece of claim 6, wherein each recess includes a first recess portion arranged to pass a respective one of the retainer fingers therethrough and a second recess portion arranged to capture the respective one of the retainer fingers to engage the retaining member to the base.

8. The game piece of claim 7, wherein the first recess portion has a width greater than a width of the second recess portion.

9. A game piece for use by a player in a game or as a collectible figure, comprising:

an article of manufacture comprising a first portion comprising a representational figure; and a second portion affixed to the first portion; and a support structure;

the second portion comprising a coupling member coupled with the support structure so that a user of the article of manufacture is enabled to couple it with the support structure and uncouple it therefrom, the coupling member being arranged to rotate freely on the support structure;

wherein the second portion includes a central member having a flat upper surface, the representational figure being affixed to the flat upper surface, and a medial ring portion extending outwardly from the central member;

the game piece further comprising indicia on one of the article of manufacture and the support structure representing a plurality of attack parameters usable in a pre-existing game and an index indicator on the other one of the article of manufacture and the support structure, said indicia being movable with respect to the other of the article of manufacture and the support structure in response to a force applied by a user to register with the index indicator, wherein selection of an attack parameter from said plurality of attack parameters is determined by a position at which said indicia rest after being moved by the user.

10. The game piece of claim 9, wherein the support structure includes a base and a retaining member releasably engaged with the base, and wherein the second portion includes an outer lip portion adapted to be captured by the base and the retaining member.

11. The game piece of claim 10, wherein the outer lip portion comprises a ring-shaped lip portion and wherein a first segment of the outer lip portion extends downwardly from the central member and a second segment of the outer lip portion extends outwardly from the first segment.

12. The game piece of claim 10, wherein the retaining member comprises a ring-shaped member and wherein an inner periphery of the retaining member is smaller than an outer periphery of the outer lip portion so that the outer lip portion is captured between the retaining member and the base when they are releasably engaged.

13. The game piece of claim 12, wherein the retaining member includes an outer skirt portion extending at least downwardly from an outer edge of the ring-shaped member and wherein a lower surface of the outer skirt portion abuts an upper surface of the base.

14. The game piece of claim 13, wherein the retaining member includes a plurality of retainer fingers formed integrally with the retaining member and interrupting the lower surface of the outer skirt portion, and the base includes a plurality of recesses, each of the plurality of retainer fingers being arranged to engage with a respective one of the recesses.

15. The game piece of claim 14, wherein the retainer fingers are equally spaced about the lower surface of the outer skirt portion of the retaining member.

16. The game piece of claim 14, wherein each retainer finger includes a downwardly projecting portion and an outwardly projecting portion, and each recess includes a first recess portion arranged to pass the outwardly projecting portion of the respective retainer finger therethrough and a second recess portion arranged to engage with the outwardly projecting portion to capture the retainer finger.

17. The game piece of claim 16, wherein the first recess portion has a width greater than a width of the second recess portion.

18. The game piece of claim 17, wherein the second recess portion is formed by an inwardly projecting flange, an upper surface of the inwardly projecting flange being co-extensive with an upper surface of the base, and a thickness of the inwardly projecting flange being smaller than a thickness of the base.

19. The game piece of claim 18, wherein one of an outer surface of the downwardly projecting portion of the retainer finger and an inner surface of the inwardly projecting flange includes a locking projection for restraining disengagement of the retaining member from the base, and the other one of the outer surface of the downwardly projecting portion and the inner surface of the inwardly projecting flange includes an indentation adapted to align with the locking projection and sized to accommodate the locking projection when the retaining member is engaged with the base.

20. The game piece of claim 14, wherein each retainer finger includes a downwardly projecting portion projecting from the lower surface of the outer skirt portion and an inwardly projecting portion, and each recess extends inwardly from an outer periphery of the base and includes a first recess portion arranged to pass the respective retainer finger therethrough and a second recess portion arranged to engage with the inwardly projecting portion of the retainer finger to capture the retainer finger.

21. The game piece of claim 20, wherein the first recess portion has a width greater than a width of the second recess portion.

22. The game piece of claim 21, wherein the second recess portion is formed by an outwardly projecting flange having an upper surface co-extensive with an upper surface of the base, and having a thickness smaller than a thickness of the base.

23. The game piece of claim 22, wherein one of an inner surface of the downwardly projecting portion of the retainer finger and an outer surface of the outwardly projecting flange includes a locking projection for restraining disengagement of the retaining member from the base, and the other one of the inner surface of the downwardly projecting portion and the outer surface of the outwardly projecting flange includes an indentation adapted to align with the locking projection and sized to accommodate the locking projection when the retaining member is engaged with the base.

24. A game piece for use by a player in a game or as a collectible figure, comprising:

an article of manufacture comprising a first portion comprising a representational figure; and a second portion affixed to the first portion; and a support structure comprising a base and a retaining member releasably engaged with the base;

The base including a support portion;

the second portion comprising a coupling member including a mounting portion adapted to fit over the support portion to mount the coupling member on the base, the coupling member being freely rotatable on the base when mounted thereon;

wherein the coupling member includes a central member having a flat upper surface, the representational figure being affixed to the flat upper surface, and a medial ring portion extending outwardly from the central member, and wherein the mounting portion is formed on a lower surface of the central member and the support portion is formed on an upper surface of the base;

the coupling member being captured by the base and the retaining member so that a user of the article of manufacture is enabled to couple it with the support structure and uncouple it therefrom;

the game piece further comprising indicia on one of the article of manufacture and the support structure representing a plurality of attack parameters usable in a preexisting game and an index indicator on the other one of the article of manufacture and the support structure, said indicia being movable with respect to the other of the article of manufacture and the support structure in response to a force applied by a user to register with the index indicator, wherein selection of an attack parameter from said plurality of attack parameters is determined by a position at which said indicia rest after being moved by the user.

25. The game piece of claim 24, wherein the support portion comprises a post having a substantially cylindrical shape and an inner surface of the mounting portion is adapted to fit closely over the post to mount the coupling member on the base.

26. The game piece of claim 24, wherein the base includes a raised platform on an upper surface of the base, the raised platform supporting a lowermost edge of the mounting portion, and wherein the mounting portion has a predetermined length such that the lowermost edge of the mounting portion does not extend beyond a lowermost surface of the medial ring portion.

27. The game piece of claim 24, wherein a lowermost edge of the mounting portion is supported by an upper surface of the base and wherein the mounting portion has a predetermined length such that the lowermost edge of the mounting portion extends beyond a lowermost surface of the medial ring portion.

28. A game piece for use by a player in a game or as a collectible figure, comprising:

an article of manufacture comprising a first portion comprising a representational figure; and a second portion affixed to the first portion; and a support structure including a base and a retaining member releasably engaged with the base;

second portion comprising a coupling member coupled with the support structure and captured by the base and the retaining member, so that a user of the article of manufacture is enabled to couple it with the support structure and uncouple it therefrom, the coupling member being arranged to rotate freely on the support structure;

wherein the base includes a lateral projection extending outwardly beyond an outer edge of the retaining member when releasably engaged with the base and of sufficient size to permit a player to grasp the lateral projection;

the game piece further comprising indicia on one of the article of manufacture and the support structure representing a plurality of attack parameters usable in a preexisting game and an index indicator on the other one of the article of manufacture and the support structure, said indicia being movable with respect to the other of the article of manufacture and the support structure in response to a force applied by a user to register with the index indicator, wherein selection of an attack parameter from said plurality of attack parameters is determined by a position at which said indicia rest after being moved by the user.

29. A game piece for use by a player in a game or as a collectible figure, comprising:

an article of manufacture comprising a first portion comprising a representational figure; and a second portion affixed to the first portion; and a support structure comprising a base and a retaining member releasably engaged with the base;

the second portion comprising a coupling member coupled with the support structure and captured by the base and the retaining member, so that a user of the article of manufacture is enabled to couple it with the support structure and uncouple it therefrom, the coupling member being freely rotatable on the support structure;

wherein the coupling member comprises a central member having an upper surface for affixing the representational figure thereto and a medial ring portion extending outwardly from the central member and including game related indicia including a plurality of sections representing at least one of an action, a condition and a capability of the game piece as attack parameters usable in a preexisting game, and wherein the retaining member includes an index indicator such that when the coupling member is rotated relative to the support structure, the game related indicia is rotated with the coupling member relative to the index indicator on the retaining member to register therewith as a selected attack parameter when the indicia rest after being moved by the user.

30. The game piece of claim 29, wherein an upper surface of the medial ring portion includes the game related indicia and an upper surface of the retaining member includes the index indicator.

31. The game piece of claim 30, wherein at least one of the parameters includes a predetermined value representing one of a damage value and a defense value.

32. The game piece of claim 30, wherein the game indicia further includes at least one figure parameter representing at least one characteristic of the game piece.

33. The game piece of claim 32, wherein the figure parameter comprises a moving value representing a maximum distance the game piece can move in one turn of a game.

34. A game for use by a player in a game or as a collectible figure, comprising:

an article of manufacture comprising a first portion comprising a representational figure; and a second portion affixed to the first portion; and a support structure comprising a base and a retaining member releasably engaged with the base, the retaining member and the base being arranged such that they may be released from engagement by rotation of the retaining member with respect to the base;

the second portion comprising a coupling member coupled with the support structure and captured between the base and the retaining member, so that a user of the article of manufacture is enabled to couple it with the support structure and uncouple it therefrom;

wherein the retaining member includes a plurality of retainer fingers formed integrally with the retaining member, and the base includes a plurality of recesses corresponding to the retainer fingers, the plurality of the retainer fingers being arranged to engage with respective recesses;

the game piece further comprising indicia on one of the article of manufacture and the support structure representing a plurality of attack parameters usable in a preexisting game, said indicia being movable with respect to the other of the article of manufacture and the support structure in response to a force applied by a user, wherein selection of an attack parameter from said plurality of attack parameters is determined by a position at which said indicia rest after being moved by the user.

35. The game piece of claim 34, wherein each recess includes a first recess portion arranged to permit a respective one of the retainer fingers to pass therethrough and a second recess portion arranged to capture the respective one of the retainer fingers to releasably engage the retaining member to the base.

36. The game piece of claim 35, wherein the coupling member includes a central member having a flat surface arranged to affix the representational figure thereto, a medial ring portion extending outwardly from the central member and an outer lip portion adapted to be captured by the base and the retaining member.

37. The game piece of claim 36, wherein the outer lip portion is ring-shaped and a first segment of the outer lip portion extends downwardly from the central member and a second segment of the outer lip portion extends outwardly from the first segment.

38. The game piece of claim 37, wherein the retaining member comprises a ring-shaped member, an inner periphery of the ring-shaped member being smaller than an outer periphery of the outer lip portion.

39. The game piece of claim 38, wherein the retaining member includes an outer skirt portion extending at least downwardly from an outer edge of the ring-shaped member and wherein a lower surface of the outer skirt portion abuts an upper surface of the base.

40. The game piece of claim 39, wherein the plurality of the retainer fingers interrupt the lower surface of the outer skirt portion, each of the retainer fingers including a downwardly projecting portion and an outwardly projecting portion, and wherein the first recess portion of each recess is arranged to permit the outwardly projecting portion of the respective retainer finger to pass therethrough and the second recess portion is arranged to engage with the outwardly projecting portion to capture the retainer finger.

41. The game piece of claim 40, wherein the second recess portion of each of the plurality of recesses is formed by an inwardly projecting flange, an upper surface of the inwardly projecting flange being co-extensive with an upper surface of the base, and a thickness of the inwardly projecting flange being smaller than a thickness of the base.

42. The game piece of claim 39, wherein each of the plurality of the retainer fingers includes a downwardly projecting portion projecting from a lower surface of the outer skirt portion and an inwardly projecting portion, and wherein each recess extends inwardly from an outer periphery of the base, the second recess portion of the recess being arranged to engage with the inwardly projecting portion of the retainer finger to capture the retainer finger.

43. The game piece of claim 42, wherein the second recess portion is formed by an outwardly projecting flange having an upper surface co-extensive with the upper surface of the base and having a thickness which is smaller than a thickness of the base.

44. A game piece for use by a player in a game or as a collectible figure, comprising:

an article of manufacture comprising a first portion comprising a representational figure; and a second portion affixed to the first portion; and a support structure comprising a base and a retaining member releasably engaged with the base, the retaining member and the base being arranged such that they may be released from engagement by rotation of the retaining member with respect to the base;

the base including a support portion;

the second portion comprising a coupling member including a mounting portion adapted to fit over the support portion to mount the coupling member on the base, the coupling portion being captured between the base and the retaining member, so that a user of the article of manufacture is enabled to couple the coupling member with the support structure and uncouple it therefrom;

wherein the coupling member includes a central member having an upper surface for affixing the representational figure and a medial ring portion extending outwardly from the central member, and wherein the mounting portion is formed on a lower surface of the central member and the support portion is formed on an upper surface of the base;

the game piece further comprising indicia on one of the article of manufacture and the support structure representing a plurality of attack parameters usable in a preexisting game, said indicia being movable with respect to the other of the article of manufacture and the support structure in response to a force applied by a user, wherein selection of an attack parameter from said plurality of attack parameters is determined by a position at which said indicia rest after being moved by the user.

45. The game piece of claim 44, wherein the base includes a raised platform on the upper surface of the base for supporting a lowermost edge of the mounting portion and wherein the mounting portion has a predetermined length such that the lowermost edge of the mounting portion does not extend beyond a lowermost surface of the medial ring portion.

46. The game piece of claim 44, wherein a lowermost edge of the mounting portion is supported by an upper surface of the base and wherein the mounting portion has a predetermined length such that the lowermost edge of the mounting portion extends beyond a lowermost surface of the medial ring portion.

47. The game piece of claim 44, wherein the support portion comprises a post having a substantially cylindrical shape and the mounting portion is arranged to fit closely over the post.

48. A game piece for use as a position marker on a game board, the game piece comprising:

a base having a rotatable top portion and a stationary bottom portion;

a plurality of slots formed in an upper surface of the bottom portion;

a post member extending above the upper surface of the bottom portion;

a raised platform surrounding the post member;

the top portion having a bushing for engaging the post member;

a retainer enclosing but not contacting an outer section of the top portion, the retainer having a plurality of fingers releasably engaged with the plurality of slots in the bottom portion, wherein the retainer prevents the top portion from unintentional separation from the bottom portion; and a game figure connected to the top portion of the base;

wherein the raised platform supports the bushing such that the bottom portion solely contacts the top portion through the bushing and wherein the top portion is freely spinnable around the post member.

49. The game piece as claimed in claim 48 wherein the bottom portion of the base includes an extension to facilitate a user in maintaining the bottom portion stationary while spinning the top portion.

50. The game piece as claimed in claim 48 wherein the top portion of the base includes a plurality of game related indicia specific to the connected game figure and wherein the retainer includes an index indicator for designating one of the plurality of game related indicia.

* * * * *